US009454094B2

(12) United States Patent
Tsujimoto et al.

(10) Patent No.: US 9,454,094 B2
(45) Date of Patent: Sep. 27, 2016

(54) MAGNETIC TONER

(71) Applicant: CANON KABUSHIKI KAISHA, Tokyo (JP)

(72) Inventors: Daisuke Tsujimoto, Matsudo (JP); Yoshihiro Ogawa, Toride (JP); Toru Takahashi, Toride (JP); Wakashi Iida, Toride (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/691,514

(22) Filed: Apr. 20, 2015

(65) Prior Publication Data

US 2015/0309432 A1 Oct. 29, 2015

(30) Foreign Application Priority Data

Apr. 24, 2014 (JP) ..... 2014-090456
Apr. 15, 2015 (JP) ..... 2015-083617

(51) Int. Cl.
*G03G 9/083* (2006.01)
*G03G 9/08* (2006.01)
*G03G 9/087* (2006.01)

(52) U.S. Cl.
CPC ..... *G03G 9/0819* (2013.01); *G03G 9/0833* (2013.01); *G03G 9/0838* (2013.01); *G03G 9/08755* (2013.01)

(58) Field of Classification Search
CPC .. G03G 9/083; G03G 9/0832; G03G 9/0836; G03G 9/0837; G03G 9/0838; G03G 9/08755
See application file for complete search history.

(56) References Cited

U.S. PATENT DOCUMENTS

| | | | |
|---|---|---|---|
| 5,750,302 | A | 5/1998 | Ogawa et al. |
| 5,858,593 | A | 1/1999 | Tamura et al. |
| 6,238,834 | B1 | 5/2001 | Tamura et al. |
| 7,422,832 | B2 | 9/2008 | Ogawa et al. |
| 7,470,494 | B2 | 12/2008 | Nishiyama et al. |
| 7,678,524 | B2 | 3/2010 | Hasegawa et al. |
| 7,939,231 | B2 | 5/2011 | Ogawa et al. |
| 8,124,306 | B2 | 2/2012 | Hirata et al. |
| 8,501,377 | B2 | 8/2013 | Takahashi et al. |
| 8,512,925 | B2 | 8/2013 | Moribe et al. |
| 8,518,620 | B2 | 8/2013 | Dojo et al. |
| 2015/0017581 | A1 | 1/2015 | Tsuchida et al. |

FOREIGN PATENT DOCUMENTS

| | | | | |
|---|---|---|---|---|
| JP | 2000-214625 | A | 8/2000 | |
| JP | 2005-37744 | A | 2/2005 | |
| JP | 2005-157318 | A | 6/2005 | |
| JP | 2005-181759 | A | 7/2005 | |
| JP | 2007-133391 | A | 5/2007 | |
| JP | 2009-012987 | * | 1/2009 | ..... C01G 49/08 |

OTHER PUBLICATIONS

Translation of JP 2009-012987 published Jan. 2009.*

* cited by examiner

*Primary Examiner* — Peter Vajda

(74) *Attorney, Agent, or Firm* — Fitzpatrick, Cella, Harper & Scinto

(57) ABSTRACT

Provided is a magnetic toner, including a toner particle containing a binder resin and a magnetic iron oxide particle, in which: the binder resin includes a resin having a polyester unit in which at least one kind of aliphatic compound selected from the group consisting of an aliphatic monocarboxylic acid having 30 to 102 carbon atoms and an aliphatic monoalcohol having 30 to 102 carbon atoms is condensed at an end of the polyester unit; a content of the magnetic iron oxide particle is from 30 to 80 parts by mass with respect to 100 parts by mass of the binder resin; and the magnetic iron oxide particle satisfies the following conditions: (i) a number-based median diameter D50 is from 0.05 to 0.15 μm; (ii) a number-based ratio D10/D50 is from 0.40 to 1.00; and (iii) a number-based ratio D90/D50 is from 1.00 to 1.50.

9 Claims, No Drawings

MAGNETIC TONER

BACKGROUND OF THE INVENTION

1. Field of the Invention

The present invention relates to a magnetic toner to be used in a method such as electrophotography, an electrostatic recording method, or a magnetic toner jet recording method.

2. Description of the Related Art

In recent years, toner has been required to be able to correspond to increases in speed and image quality of an image forming apparatus of an electrophotographic type, such as a copying machine or a printer. In addition, an environment in which the toner is used has been diversified, and the toner has been required to be able to provide a stable image even when used in various environments.

As a developing method to be employed in the image forming apparatus, a one-component developing method using a developing device having a simple structure is preferably used from the viewpoints of less trouble, a longer lifetime, and easier maintenance.

As the one-component developing method, some methods are known. One of those methods is a jumping developing method using a magnetic toner (hereinafter also referred to simply as "toner") including magnetic toner particles (hereinafter also referred to simply as "toner particles") containing magnetic iron oxide particles. The jumping developing method is a method involving allowing the magnetic toner charged by triboelectric charging with a toner carrying member to fly and adhere onto a surface of an electrostatic latent image bearing member (electrophotographic photosensitive member or the like) by using a developing bias, to develop (visualize) an electrostatic latent image (electrostatic charge image) on the electrostatic latent image bearing member. The jumping developing method is widely put into practical use from the viewpoints of easy conveyance control of the magnetic toner and less contamination in the image forming apparatus.

When a content of the magnetic iron oxide particles in the toner particles is reduced, a magnetic brush on the toner carrying member can be reduced in height and uniform magnetic brush formation can be achieved, and thus the magnetic toner tends to cause less tailing and scattering, and provide satisfactory image quality. In addition, the reduction in content of the magnetic iron oxide particles is also advantageous from the viewpoint of reducing a toner consumption amount, because an image can be formed without using unnecessary toner.

From such viewpoints, the magnetic toner has been required to achieve a reduction in content of the magnetic iron oxide particles in the toner particles.

In addition, a binder resin in the toner particles has great influences on the above-mentioned characteristics of the toner. Examples of the binder resin in the toner particles include a polystyrene resin, a styrene-acrylic resin, a polyester resin, an epoxy resin, and a polyamide resin. Of those resins, a polyester resin, which exhibits excellent low-temperature fixability and the like, has recently attracted attention.

As described above, the environment in which the toner is used has been diversified in recent years. Now, adaptability of the toner to various environments is focused, and one factor having particularly great influences among environmental factors is humidity. The humidity has influences on a charge amount and charge amount distribution of the toner, causes variations in developability, and in addition, has a great influence on transferability.

In a transfer step of transferring the toner from the surface of the electrostatic latent image bearing member onto paper, a charge having a polarity opposite to that of the toner is imparted to the paper from its back surface, to charge the surface of the paper with a polarity opposite to that of the toner, to thereby transfer the toner. At this time, while only the surface of the paper is intended to be charged, the charge passes the paper from its back surface to its front surface depending on a kind of the paper or humidity and charges also the toner on the surface of the electrostatic latent image bearing member in some cases. In those cases, the toner is charged with a polarity opposite to its original polarity. Such phenomenon is called "transfer penetration." When the transfer penetration occurs, the toner may be prevented from being transferred onto the paper and remain on the surface of the electrostatic latent image bearing member, and a toner image may be disturbed at the time of transferring, resulting in blank areas or unevenness in the toner image transferred onto the paper. In addition, a half-tone image or the like may be coarse. Such phenomenon is particularly remarkable when the image is output in a high-temperature and high-humidity environment.

Japanese Patent Application Laid-Open Nos. 2000-214625 and 2005-37744 each disclose a technology for solving the problem by externally adding the magnetic iron oxide particles to the toner particles.

In addition, Japanese Patent Application Laid-Open No. 2005-157318 discloses a technology involving reducing the content of the magnetic iron oxide particles in the toner particles as compared to that in the related art and controlling a saturated magnetization amount and dielectric loss tangent of the magnetic iron oxide particles.

In addition, Japanese Patent Application Laid-Open Nos. 2005-181759 and 2007-133391 each disclose that a resin obtained by introducing a long-chain alkyl group in a polyester resin is used in the toner particles in order to improve dispersibility of wax in the toner particles.

However, the technologies disclosed in Japanese Patent Application Laid-Open Nos. 2000-214625 and 2005-37744 each have an insufficient effect of suppressing the transfer penetration in a high-humidity environment, in which the transfer penetration is liable to occur.

In addition, in the technology disclosed in Japanese Patent Application Laid-Open No. 2005-157318, the magnetic iron oxide particles are liable to be unevenly distributed in the toner particles. In addition, even if the magnetic iron oxide particles are uniformly dispersed in the toner particles, electrical resistance is liable to vary in the toner particles between a portion in which larger magnetic iron oxide particles are present and a portion in which smaller magnetic iron oxide particles are present, unless the magnetic iron oxide particles have a sharp particle size distribution. As a result, the technology has an insufficient effect of suppressing the transfer penetration in use in an environment in which the transfer penetration is liable to occur.

In addition, Japanese Patent Application Laid-Open Nos. 2005-181759 and 2007-133391 do not make detailed investigations on the magnetic iron oxide particles.

As described above, there has been a demand for a magnetic toner using a polyester resin exhibiting excellent low-temperature fixability and the like, and concurrently achieving a reduction in content of the magnetic iron oxide particles in the toner particles from the viewpoints of magnetic brush height reduction and uniform magnetic brush formation.

However, when the content of the magnetic iron oxide particles is reduced, a problem of poor dispersibility of the magnetic iron oxide particles in the toner particles is liable to occur. As a result, electrical resistance is liable to vary in the toner particles between a portion in which the magnetic iron oxide particles are present and a portion in which the magnetic iron oxide particles are absent, and thus the transfer penetration is liable to occur.

In addition, as a result of investigations made by the inventors of the present invention, the polyester resin has been found to be more liable to cause the transfer penetration than other resins.

Japanese Patent Application Laid-Open Nos. 2000-214625, 2005-37744, 2005-157318, 2005-181759, and 2007-133391 do not make investigations on the problem of the transfer penetration in the magnetic toner using as the binder resin in the toner particles a polyester resin and achieving a reduction in content of the magnetic iron oxide particles in the toner particles.

SUMMARY OF THE INVENTION

One aspect of the present invention is directed to providing a magnetic toner that exhibits excellent low-temperature fixability, causes less tailing and scattering, and causes less blank areas, unevenness, and coarseness in a toner image owing to transfer penetration.

According to one aspect of the present invention, there is provided a magnetic toner, including a toner particle containing a binder resin and a magnetic iron oxide particle, in which:

the binder resin includes a resin having a polyester unit in which at least one kind of aliphatic compound selected from the group consisting of an aliphatic monocarboxylic acid having 30 or more and 102 or less carbon atoms and an aliphatic monoalcohol having 30 or more and 102 or less carbon atoms is condensed at an end of the polyester unit;

a content of the magnetic iron oxide particle in the toner particle is 30 parts by mass or more and 80 parts by mass or less with respect to 100 parts by mass of the binder resin in the toner particle; and the magnetic iron oxide particle satisfies the following conditions (i) to (iii):

(i) a number-based median diameter D50 is 0.05 μm or more and 0.15 μm or less;

(ii) a ratio D10/D50 is 0.40 or more and 1.00 or less, when a particle diameter at which a cumulative ratio in a number-based particle size distribution from a smaller particle diameter side reaches 10% is defined as D10; and (iii) a ratio D90/D50 is 1.00 or more and 1.50 or less, when a particle diameter at which a cumulative ratio in the number-based particle size distribution from the smaller particle diameter side reaches 90% is defined as D90.

According to the one aspect of the present invention, it is possible to provide the magnetic toner that exhibits excellent low-temperature fixability, causes less tailing and scattering, and causes less blank areas, unevenness, and coarseness in a toner image owing to transfer penetration.

Further features of the present invention will become apparent from the following description of exemplary embodiments.

DESCRIPTION OF THE EMBODIMENTS

A magnetic toner of the present invention uses as a binder resin in toner particle a resin having a polyester unit (hereinafter also referred to simply as "polyester resin"). In the present invention, the "polyester unit" means a unit derived from polyester. In addition, the "resin having a polyester unit" includes a so-called polyester resin, and as well, a hybrid resin in which the polyester unit and another polymer unit (resin unit) are chemically bonded to each other. A resin for forming the other polymer unit is exemplified by a vinyl-based polymer (vinyl-based resin), polyurethane (polyurethane resin), an epoxy-based polymer (epoxy resin), or a phenol-based polymer (phenol resin). Of those resins, a vinyl-based polymer (vinyl-based polymer unit) is preferred. In addition, the mass ratio of the polyester unit to the vinyl-based polymer unit (polyester unit/vinyl-based polymer unit) is preferably 90/10 or more and 50/50 or less.

In addition, in the magnetic toner of the present invention, the content of magnetic iron oxide particle is set to as relatively small a content as 30 parts by mass or more and 80 parts by mass or less with respect to 100 parts by mass of the binder resin in the toner particle. In addition, the particle diameter of the magnetic iron oxide particle is set to as relatively small a particle diameter as 0.05 μm or more and 0.15 μm or less in terms of number-based median diameter D50. The inventors of the present invention have found that a magnetic toner that exhibits excellent low-temperature fixability and causes less tailing and scattering is obtained by the above-mentioned configurations.

The reason why the above-mentioned configurations result in less tailing and scattering is as described below. When the content of the magnetic iron oxide particle falls within the above-mentioned range, a magnetic brush of the magnetic toner on a toner carrying member can be reduced in height, and uniform magnetic brush formation can be achieved. In addition, when the number-based median diameter D50 of the magnetic iron oxide particle falls within the above-mentioned range, the number of the magnetic iron oxide particles can be sufficiently secured even when the content of the magnetic iron oxide particle in the toner particle falls within the above-mentioned range. Therefore, the magnetic iron oxide particles can secure a uniformly dispersed state in the toner particles.

Herein, the "number-based median diameter D50" represents a diameter at the point at which, when particles are sized from the largest and from the smallest, the number of larger particles is equal to the number of smaller particles. The number-based median diameter D50 is hereinafter also referred to simply as "D50".

However, the inventors have also found that, when the magnetic toner having the above-mentioned configurations is used to form an image in a high-humidity environment, the image is liable to be coarse, and image quality is liable to be reduced. This problem tends to easily occur when the image is formed by using a copying machine or printer without a post-charging device for improving transferability.

The inventors have investigated the cause of the coarse image, and as a result, have found that dot disturbance albeit in a slight level is liable to occur in the output image. The inventors have also found that the dot disturbance is liable to occur in transferring onto paper, not onto the surface of an electrostatic latent image bearing member. The inventors have also found that even the toner particle forming dot disturbance contains a sufficient amount of the magnetic iron oxide particle.

In view of the foregoing, the inventors presume the cause of the coarse image as described below.

In general, when toner is transferred from the surface of the electrostatic latent image bearing member onto paper in a transfer step, a charge having a polarity opposite to that of the toner is imparted to the paper from its back surface, to charge the surface of the paper with a polarity opposite to that of the toner. Thus, the toner on the surface of the electrostatic latent image bearing member is transferred onto the surface of the paper.

At this time, while only the paper is intended to be charged, there may occur a phenomenon called "transfer penetration," in which the charge passes the paper from its back surface to its front surface under the influence of the kind of the paper or humidity, and charges the toner on the surface of the electrostatic latent image bearing member with a polarity opposite to its original polarity.

When the toner particles vary in the content of the magnetic iron oxide particles, the toner particles are liable to be affected by the transfer penetration, and an adverse effect such as blank areas or unevenness is liable to occur in a toner image that is an output image. As a result of further investigations made by the inventors, it has been found that, even when the toner particles less vary in the content of the magnetic iron oxide particles, electrical resistance is liable to vary in the toner particles, unless the magnetic iron oxide particles are uniformly dispersed at a micro level in the toner particles. It has been found that, when the electrical resistance varies in the toner particles, the toner particles are partly affected by the transfer penetration.

In addition, even when the magnetic iron oxide particles are uniformly dispersed at a micro level in the toner particles, the electrical resistance is liable to vary in the toner particles between a portion in which larger magnetic iron oxide particles are present and a portion in which smaller magnetic iron oxide particles are present. It has been found that, when the electrical resistance varies in the toner particles, the toner particles are partly affected by the transfer penetration.

It is considered that, when the toner is transferred from the surface of the electrostatic latent image bearing member onto the paper, the toner is transferred onto a position slightly shifted from the position onto which the toner is to be transferred under the influence of the transfer penetration, which may result in the dot disturbance at a slight level, and an increase in coarseness.

The inventors consider the reason why such phenomenon has not hitherto been paid attention as described below.

In the case of using a magnetic toner in which the content of the magnetic iron oxide particle in the toner particle is large and/or the particle diameter and the like of the magnetic iron oxide particle in the toner particle is prevented from being controlled, original image quality is not that good. As a result, the coarseness caused by the dot disturbance at a slight level is inconspicuous.

The inventors have found that, when the magnetic iron oxide particle satisfies the following conditions (ii) and (iii) in addition to the above-mentioned condition (i), the toner image has less unevenness in a high-humidity environment even when a polyester resin is used as the binder resin in the toner particle and the content of the magnetic iron oxide particle in the toner particle is reduced:

(i) the number-based median diameter D50 is 0.05 μm or more and 0.15 μm or less;

(ii) the ratio D10/D50 is 0.40 or more and 1.00 or less; and (iii) the ratio D90/D50 is 1.00 or more and 1.50 or less.

Herein, D10 represents a particle diameter at which a cumulative ratio in a number-based particle size distribution from a smaller particle diameter side reaches 10%. In addition, D90 represents a particle diameter at which a cumulative ratio in a number-based particle size distribution from a smaller particle diameter side reaches 90%. The number-based D10 is hereinafter also referred to simply as "D10", and the number-based D90 is hereinafter also referred to simply as "D90".

The fact that the ratio D10/D50 is 0.40 or more and 1.00 or less means that the magnetic iron oxide particles have a sharp particle size distribution on a finer particle (smaller-particle-diameter particle) side in a number-based particle size distribution thereof. In addition, the fact that the ratio D90/D50 is 1.00 or more and 1.50 or less means that the magnetic iron oxide particles have a sharp particle size distribution on a coarser particle (larger-particle-diameter particle) side in a number-based particle size distribution thereof. For example, two kinds of magnetic iron oxide particles having the same average particle diameter and different particle size distributions are considered. In this case, it can be said that the particle having a ratio D10/D50 of 0.40 or more and 1.00 or less and a ratio D90/D50 of 1.00 or more and 1.50 or less have a sharper particle size distribution than particle having a ratio D10/D50 of less than 0.40 or a ratio D90/D50 of more than 1.50.

When the ratios D10/D50 and D90/D50 are controlled within the above-mentioned ranges, the magnetic iron oxide particles in the toner particles have a uniform size, and the electrical resistance easily becomes uniform in the toner particles.

In addition, the inventors have found that the use of the resin having a polyester unit in which at least one kind of aliphatic compound selected from the group consisting of an aliphatic monocarboxylic acid having 30 or more and 102 or less carbon atoms and an aliphatic monoalcohol having 30 or more and 102 or less carbon atoms is condensed at an end of the polyester unit, as the binder resin in the toner particle, has an effect on dispersion of the magnetic iron oxide particle. The inventors presume the reason for this as described below.

When the aliphatic compound having 30 or more and 102 or less carbon atoms is introduced at an end of the polyester unit through a chemical reaction (condensation reaction), a state in which carbon chains derived from the introduced aliphatic compound are microscopically dispersed in the resin can be achieved. The aliphatic compound preferably has 32 or more and 80 or less carbon atoms, more preferably has 32 or more and 60 or less carbon atoms.

Herein, it is important that the aliphatic compound be monovalent. Such monovalent aliphatic compound is condensed at an end of the polyester unit. The carbon chains derived from the aliphatic compound condensed at the end each act as a soft segment in the resin. A state in which the soft segments are uniformly dispersed in the resin is achieved by virtue of the carbon chains derived from the aliphatic compound being microscopically dispersed in the resin. It is considered that the magnetic iron oxide particles can be dispersed in an entirely uniform state from the soft segments at a micro level present uniformly in the resin, without being unevenly distributed in part of the resin, then in part of the toner particles. When the magnetic iron oxide particles are uniformly dispersed in the toner particles, the transfer penetration is suppressed, resulting in less coarseness. In addition, when the magnetic iron oxide particles are uniformly dispersed in the toner particles, uniform magnetic brush formation is achieved on the toner carrying member, resulting in less tailing and scattering, and less density reduction and fogging in the toner image.

When the aliphatic compound has 30 or more carbon atoms, the soft segments each have a sufficiently large size, and easily serve as origins from which the magnetic iron oxide particles are dispersed in the toner particles. When the aliphatic compound has 102 or less carbon atoms, the soft segments are not excessively large, and a state in which the soft segments at a micro level are uniformly present in the resin is easily achieved. Thus, the magnetic iron oxide particles are uniformly dispersed with ease. In addition, the state in which the soft segments are uniformly present in the resin is also effective for improving the low-temperature fixability of the magnetic toner.

As described above, the magnetic iron oxide particle according to the present invention has a D50 of 0.05 μm or more and 0.15 μm or less. The magnetic iron oxide particle preferably has a D50 of 0.10 μm or more and 0.14 μm or less. When the magnetic iron oxide particle has a D50 of 0.05 μm or more and 0.15 μm or less, and the content of the magnetic iron oxide particle is 30 parts by mass or more and 80 parts by mass or less with respect to 100 parts by mass of the binder resin in the toner particle, the number of the magnetic iron oxide particles is sufficiently secured in the magnetic toner. With this, the magnetic brush on the toner carrying member can be reduced in height, and uniform magnetic brush formation can be achieved. Thus, the tailing and the scattering can be suppressed.

When the magnetic iron oxide particle has a D50 of 0.15 μm or less in the above-mentioned content range, the number of the magnetic iron oxide particles is sufficiently secured in the magnetic toner. With this, the content of the magnetic iron oxide particles hardly varies in the magnetic toner particles. As a result, the magnetic brush formation on the toner carrying member hardly becomes non-uniform, resulting in less tailing and scattering, and less density reduction and fogging in the toner image. In addition, the blank areas, unevenness, and coarseness due to the transfer penetration are less liable to occur in the toner image.

In addition, when the magnetic iron oxide particle has a D50 of 0.05 μm or more in the above-mentioned content range, the magnetic force of the magnetic iron oxide particle is sufficiently secured. Thus, the magnetic force of the magnetic toner is sufficiently secured. As a result, the magnetic brush is easily formed on the toner carrying member, resulting in less tailing and scattering, and less density reduction and fogging in the toner image. In addition, the blank areas, unevenness, and coarseness due to the transfer penetration are less liable to occur.

In addition, the inventors have found that, in the case of using the magnetic iron oxide particle having a small particle diameter, it is necessary for sufficiently achieving the effects of the present invention to control the respective ranges of the ratios D10/D50 and D90/D50, in addition to the range of the D50 of the magnetic iron oxide particle. That is, in the present invention, the magnetic iron oxide particle has a ratio D10/D50 of 0.40 or more and 1.00 or less, and a ratio D90/D50 of 1.00 or more and 1.50 or less. The ratio D10/D50 is preferably 0.45 or more and 1.00 or less, more preferably 0.50 or more and 1.00 or less, still more preferably 0.55 or more and 1.00 or less. In addition, the ratio D90/D50 is preferably 1.00 or more and 1.47 or less, more preferably 1.00 or more and 1.45 or less. This is because, even when the magnetic iron oxide particles are uniformly dispersed in the toner particles, the electrical resistance varies in the toner particles between a portion in which larger magnetic iron oxide particles are present and a portion in which smaller magnetic iron oxide particles are present, unless the magnetic iron oxide particles have a sharp particle size distribution.

When the ratio D10/D50 is 0.40 or more, the particle size distribution becomes sharp on a finer particle side, and a portion including a larger number of magnetic iron oxide particles hardly exists in the toner particles. As a result, the electrical resistance is less liable to vary in the toner particles. Thus, a portion liable to be affected by the transfer penetration is reduced in the toner particles, resulting in less coarseness. In addition, when the magnetic iron oxide particles have a sharp particle size distribution, the magnetic brush is uniformly formed on the toner carrying member, resulting in less tailing and scattering, and less density reduction and fogging in the toner image.

When the ratio D90/D50 is 1.50 or less, the particle size distribution becomes sharp on a coarser particle side, and a portion including a smaller number of magnetic iron oxide particles hardly exists in the toner particles. As a result, the electrical resistance is less liable to vary in the toner particles. Thus, a portion liable to be affected by the transfer penetration is reduced in the toner particles, resulting in less coarseness. In addition, when the magnetic iron oxide particles have a sharp particle size distribution, the magnetic brush is uniformly formed on the toner carrying member, resulting in less tailing and scattering, and less density reduction and fogging in the toner image.

The magnetic iron oxide particles according to the present invention are obtained by uniformly conducting an oxidation reaction by, for example, conducting the oxidation reaction in a divided manner or performing stirring during the oxidation reaction in the production of the magnetic iron oxide particles. In addition, the magnetic iron oxide particles may be obtained through classification with a classifier, so as to achieve a ratio D10/D50 of 0.40 or more and 1.00 or less and a ratio D90/D50 of 1.00 or more and 1.50 or less.

For example, the following classifiers are given as a dry classifier as a classifier that may be used for removal of the fine powder and coarse powder of the magnetic iron oxide particles: Elbow-Jet (trade name) manufactured by Nittetsu Mining Co., Ltd., Fine Sharp Separator (trade name) manufactured by Hosokawa Micron Corporation, Variable Impactor (trade name) manufactured by Sankyo Dengyo Corporation, Spedic Classifier (trade name) manufactured by Seishin Enterprise Co., Ltd., DONASELEC (trade name) manufactured by Nippon Donaldson, Ltd., and YM Micro Cut (trade name) manufactured by Yasukawa Shoji K.K. In addition, the following other dry classifying apparatus may be used: various air separators, Micron Separator, Mikroplex, Acucut, and the like. In addition, for example, a thickener, a tubular centrifuge, and a disc centrifuge are given as a wet classifier.

Those classifiers may be used alone or in combination of two or more kinds.

The magnetic iron oxide particles according to the present invention may be obtained by conducting a classification step once or a plurality of times.

By the following production method, the magnetic iron oxide particles can achieve a sharper particle size distribution than that obtained by a classification operation.

As a method of obtaining the magnetic iron oxide particles having a small particle diameter, there is given, for example, a method involving conducting an oxidation reaction step in two stages in the production of the magnetic iron oxide particles, to carefully grow crystals of the magnetic iron oxide particles, to thereby obtain the magnetic iron oxide particles having a small particle diameter.

However, it is difficult to uniformly conduct the oxidation reaction by merely conducting the oxidation reaction step in a divided manner, unless the magnetic iron oxide particles are sufficiently stirred during the reaction. Unless the oxidation reaction in the production of the magnetic iron oxide particles is uniform, the crystals of the magnetic iron oxide particles are liable to be grown non-uniformly, and the magnetic iron oxide particles having a sharp particle size distribution are hardly obtained.

Therefore, in order to obtain the magnetic iron oxide particles having a ratio D10/D50 of 0.40 or more and 1.00 or less and a ratio D90/D50 of 1.00 or more and 1.50 or less, it is preferred to carefully grow the crystals of the magnetic iron oxide particles so that the magnetic iron oxide particles proceed with uniform crystal growth. For this, it is preferred to subject a solution in a slurry form containing the magnetic iron oxide particles to uniform mixing during the oxidation reaction, to thereby uniformize the growth of the magnetic iron oxide particles.

As a method for this, there is given, for example, the following method.

First, the oxidation reaction step in the production of the magnetic iron oxide particles is conducted in a divided manner, and the pH of the solution in a slurry form containing the magnetic iron oxide particles is adjusted to reduce the viscosity of the solution in a slurry form, to thereby facilitate stirring. In this state, the solution in a slurry form is uniformly stirred, to allow the magnetic iron oxide particles to proceed with uniform crystal growth.

In addition, the magnetic iron oxide particles in the solution may be allowed to proceed with uniform crystal growth by stopping the crystal growth of the magnetic iron oxide particles once, followed by vigorously and mechanically stirring the solution in a slurry form.

A preferred production method for the magnetic iron oxide particles according to the present invention is hereinafter described.

The magnetic iron oxide particles according to the present invention are obtained by conducting the following steps:

a first reaction step of forming seed particles of the magnetic iron oxide particles;

a second reaction step of growing the seed particles; and a third reaction step of further growing the particles after the second reaction step while the solution in a slurry form containing the magnetic iron oxide particles is sufficiently stirred, to thereby obtain the intended magnetic iron oxide particles.

By conducting the reaction step in three stages, the crystals of the magnetic iron oxide particles are carefully grown. Further, by stirring the solution in a slurry form containing the magnetic iron oxide particles during the reaction to allow the magnetic iron oxide particles to proceed with uniform crystal growth, the crystal shapes of the magnetic iron oxide particles are uniformized, and thus the magnetic iron oxide particles having a sharp particle size distribution can be obtained.

<First Reaction Step>

A ferrous salt aqueous solution and an alkali hydroxide aqueous solution in an amount of 0.90 equivalent or more and 1.00 equivalent or less with respect to a ferrous salt in the ferrous salt aqueous solution are allowed to react with each other. A water-soluble silicate salt in an amount of 0.05 atomic % or more and 1.00 atomic % or less in terms of silicon atoms with respect to iron atoms is added to the obtained ferrous salt solution containing a ferrous hydroxide colloid. The amount of 0.05 atomic % or more and 1.00 atomic % or less in terms of silicon atoms with respect to iron atoms means that the amount of silicon atoms is 0.05 or more and 1.00 or less when the amount of iron atoms contained in the ferrous salt solution is defined as 100.

Next, the pH of the ferrous salt reaction solution containing the ferrous hydroxide colloid is adjusted to 8.0 or more and 9.0 or less.

Next, while the reaction solution is heated in a temperature range of 70° C. or more and 100° C. or less, an oxidation reaction is conducted by allowing an oxygen-containing gas to pass therethrough until the oxidation reaction rate of iron becomes 7% or more and 12% or less. Thus, magnetite nucleus crystal particles are formed.

<Second Reaction Step>

An alkali hydroxide aqueous solution such as a sodium hydroxide aqueous solution is added to the obtained ferrous salt reaction solution containing the magnetite nucleus crystal particles and the ferrous hydroxide colloid so that the amount of the alkali hydroxide aqueous solution is 1.01 equivalents or more and 1.50 equivalents or less with respect to the ferrous salt reaction solution.

Next, while the reaction solution is heated in a temperature range of 70° C. or more and 100° C. or less, the oxidation reaction is conducted by allowing an oxygen-containing gas to pass therethrough until the oxidation reaction rate of iron becomes from 40 to 60%.

<Third Reaction Step>

The pH of the reaction solution is adjusted to 5.0 or more and 9.0 or less while the reaction solution is stirred, to reduce the viscosity of the reaction solution and thus facilitate stirring. Then, the reaction solution is uniformly stirred. Herein, the reason why the pH is adjusted to such alkaline to neutral side is that the viscosity of the reaction solution is reduced and thus stirring is facilitated through such adjustment. The pH of the reaction solution for reducing the viscosity of the reaction solution and thus facilitating stirring is referred to as "intermediate condition".

After that, the pH is adjusted to 9.5 or more again. Then, a water-soluble silicate salt is added thereto in an amount of 20 mass % or more and 200 mass % or less with respect to the water-soluble silicate salt added in the first reaction step (so that the total amount of silicon atoms added in the first reaction step and the third reaction step is 1.9 atomic % or less).

After that, while the reaction solution is heated in a temperature range of 70° C. or more and 100° C. or less, the oxidation reaction is conducted by allowing an oxygen-containing gas to pass therethrough.

In order to allow silicon atoms and/or aluminum atoms to be incorporated in the surfaces of the magnetic iron oxide particles, for example, the following operation is performed.

A water-soluble silicate salt, or a water-soluble silicate salt and a water-soluble aluminum salt are added to a suspension containing the magnetic iron oxide particles after the completion of the third reaction step. After that, the temperature of the suspension is adjusted to 80° C. or more (preferably 90° C. or more), and the pH of the suspension is adjusted to a range of 5 or more and 9 or less (preferably 7 or more and 9 or less), to allow a compound containing silicon atoms and/or aluminum atoms to precipitate and deposit on the surfaces of the magnetic iron oxide particles. At the time of the loading of the water-soluble silicate salt, an aqueous solution containing another element may be loaded together.

In addition, the compound containing silicon atoms and/or aluminum atoms may be fixed on the surfaces of the magnetic iron oxide particles by performing mechanochemical treatment or heat treatment on the magnetic iron oxide particles after the completion of the third reaction step.

In each of the reactions, a salt containing, as an element other than iron, at least one kind of element selected from the group consisting of Mn, Zn, Ni, Cu, Al, Ti, and Si may be added as required. With this, the other element can be incorporated therein. Examples of the salt include a sulfate salt, a nitrate salt, and a chloride salt. The amount of the salt to be added is preferably such an amount that the total amount of the above-mentioned elements is more than 0 atomic % and 10 atomic % or less with respect to iron atoms. The amount of the salt to be added is such an amount that the total amount is more preferably more than 0 atomic % and 8 atomic % or less, still more preferably more than 0 atomic % and 5 atomic % or less.

The content of the magnetic iron oxide particle in the toner particle according to the present invention is 30 parts by mass or more and 80 parts by mass or less with respect to 100 parts by mass of the binder resin in the toner particle. The content of the magnetic iron oxide particle is preferably 40 parts by mass or more and 75 parts by mass or less. When the content of the magnetic iron oxide particle is 30 parts by mass or more with respect to 100 parts by mass of the binder resin, the amount of the magnetic toner flying from the surface of the toner carrying member to the surface of the electrostatic latent image bearing member is easily controlled by a magnetic confining force generated between the magnetic toner and magnets in the toner carrying member. As a result, the fogging and the tailing are easily suppressed. In addition, when the content of the magnetic iron oxide particle is 80 parts by mass or less with respect to 100 parts by mass of the binder resin, the number of the magnetic iron oxide particles exposed on the surfaces of the toner particles does not become too large, and the magnetic iron oxide particles hardly cause charge leakage. As a result, the fogging and the tailing are suppressed.

The magnetic iron oxide particle according to the present invention preferably contains silicon atoms at a content of 0.19 atomic % or more and 1.90 atomic % or less with respect to iron atoms. When the content of silicon atoms falls within the range of 0.19 atomic % or more and 1.90 atomic % or less with respect to iron atoms, the magnetic iron oxide particle easily achieves an excellent degree of blackness.

The magnetic iron oxide particle according to the present invention preferably contains in its surface aluminum atoms at a content of 0.10 atomic % or more and 1.00 atomic % or less with respect to iron atoms. When the content of aluminum atoms in the surface of the magnetic iron oxide particle falls within the range of 0.10 atomic % or more and 1.00 atomic % or less with respect to iron atoms, the chargeability of the magnetic toner is easily controlled, and the tailing and the scattering are more easily suppressed.

The magnetic iron oxide particle more preferably contains in its surface both silicon atoms and aluminum atoms. A preferred ratio between the amount of silicon atoms, A, and the amount of aluminum atoms, C, in the surface of the magnetic iron oxide particle is described later.

The amount of eluted silicon atoms is represented by A when the silicon atoms present in the surface of the magnetic iron oxide particle are eluted with hydrochloric acid. In addition, the amount of eluted silicon atoms is represented by B when the silicon atoms present in the surface of the magnetic iron oxide particle are eluted with a sodium hydroxide aqueous solution. In this case, the ratio (B/A)×100 is preferably 50(%) or less, more preferably 42(%) or less. The measurement methods for the amounts of silicon atoms A and B are described later.

The value of the above-mentioned ratio (B/A)×100 represents a relation between the eluting property of the silicon atoms present in the surface of the magnetic iron oxide particle to hydrochloric acid and the eluting property to a sodium hydroxide aqueous solution. In addition, the fact that the value of the ratio (B/A)×100 is 50(%) or less means that the silicon atoms are uniformly and fixedly present in the surface of the magnetic iron oxide particle.

When the magnetic iron oxide particles are dissolved with hydrochloric acid, almost all the silicon atoms present in the surfaces of the magnetic iron oxide particles are eluted, because the magnetic iron oxide particles are soluble in hydrochloric acid. This is because that the silicon atoms uniformly and fixedly present in the surfaces of the magnetic iron oxide particles are eluted through dissolution of the magnetic iron oxide particles.

In contrast, the magnetic iron oxide particles are hardly soluble (insoluble) in a sodium hydroxide aqueous solution. Therefore, the amount of eluted silicon atoms B in the case where the magnetic iron oxide particle is to be dissolved with a sodium hydroxide aqueous solution represents the amount of silicon atoms in a state of being able to be eluted with the sodium hydroxide aqueous solution among the silicon atoms present in the surface of the magnetic iron oxide particle.

The fact that the above-mentioned ratio (B/A)×100 is 50(%) or less means that the amount of the silicon atoms in a state of being able to be eluted with a sodium hydroxide aqueous solution is reduced on the surface of the magnetic iron oxide particle. In the case where the amount of the silicon atoms in a state of being able to be eluted with a sodium hydroxide aqueous solution is small, it is considered that the silicon atoms are each present in a chemically stable state in the surfaces of the magnetic iron oxide particles. As a result, the magnetic iron oxide particles are easily dispersed from the soft segments resulting from the carbon chains derived from the aliphatic compound in the polyester unit. Thus, the magnetic iron oxide particles are more uniformly dispersed in the toner particles. The inventors presume the reason for this as described below.

When the silicon atoms are uniformly and fixedly present in the surface of the magnetic iron oxide particle, it is considered that the number of silanol groups (Si—OH) present in the surface of the magnetic iron oxide particle is small, and the silicon atoms are each present in a chemically stable state in the surface of the magnetic iron oxide particle. As a result, it is considered that an interaction with a carboxy group or hydroxy group in the polyester unit is reduced, and the magnetic iron oxide particles more stably interact with the soft segments resulting from the carbon chains derived from the aliphatic compound and are dispersed in an entirely more uniform state in the resin.

For the above-mentioned reason, the magnetic iron oxide particles exhibit more satisfactory dispersibility in the toner particles, and thus the variations in the electrical resistance in the toner particles are more suppressed. In consequence, the transfer penetration is less liable to occur, resulting in less coarseness. In addition, the magnetic iron oxide particles are dispersed in a more uniform state, and thus a magnetic brush is more uniformly formed on the toner carrying member. In consequence, the tailing and the scattering are more suppressed, and the fogging is more suppressed.

In order to achieve such presence state of the silicon atoms, it is preferred that aluminum atoms as well as silicon atoms be incorporated in the surface of the magnetic iron oxide particle. The operation (method) of allowing silicon atoms and/or aluminum atoms to be incorporated in the surface of the magnetic iron oxide particle is as described above.

In the case where silicon atoms and aluminum atoms are incorporated in the surface of the magnetic iron oxide particle by the above-mentioned operation, both the atoms are considered to be present in a boehmite structure or an approximate boehmite structure in the surface of the magnetic iron oxide particle. The boehmite structure is one of the crystal structures of aluminum hydrate, and has high chemical stability. When silicon atoms and aluminum atoms are incorporated in the surface of the magnetic iron oxide particle by the above-mentioned operation, the silicon atoms are considered to be present in a finely dispersed state in the boehmite structure. Therefore, the silicon atoms can be fixedly and uniformly present in the surface of the magnetic iron oxide particle in a chemically more stable manner. As a result, it is considered that the magnetic iron oxide particles more stably act on the carbon chains derived from the aliphatic compound, and are dispersed in an entirely uniform state in the resin. As a result, the magnetic iron oxide particles exhibit more satisfactory dispersibility in the toner particles, and thus the variations in the electrical resistance in the toner particles are more suppressed. In consequence, the transfer penetration is less liable to occur, resulting in less coarseness. In addition, the magnetic iron oxide particles are dispersed in a more uniform state, and thus a magnetic brush is more uniformly formed on the toner carrying member. In consequence, the tailing and the scattering are more suppressed, and the fogging is more suppressed.

The magnetic iron oxide particle according to the present invention preferably has an octahedral shape. When the magnetic iron oxide particle has an octahedral shape, the magnetic iron oxide particle exhibits more satisfactory dispersibility in the binder resin, and thus the fogging is more suppressed.

As described above, the toner particle according to the present invention contains as the binder resin the resin having a polyester unit in which the aliphatic compound is condensed at an end of the polyester unit (polyester resin).

Components for forming the polyester resin according to the present invention are described. The following components may be used alone or in combination of two or more kinds.

For example, the following dicarboxylic acids and derivatives thereof are given as divalent acid components for forming the polyester resin: benzenedicarboxylic acids such as phthalic acid, terephthalic acid, isophthalic acid, and phthalic anhydride, and anhydrides thereof and lower alkyl esters thereof; alkyldicarboxylic acids such as succinic acid, adipic acid, sebacic acid, and azelaic acid, and anhydrides thereof and lower alkyl esters thereof; alkenylsuccinic acids and alkylsuccinic acids each having 1 or more and 50 or less carbon atoms, and anhydrides thereof and lower alkyl esters thereof; and unsaturated dicarboxylic acids such as fumaric acid, maleic acid, citraconic acid, and itaconic acid, and anhydrides thereof and lower alkyl esters thereof.

For example, the following alcohols are given as divalent alcohol components for forming the polyester resin: ethylene glycol, polyethylene glycol, 1,2-propanediol, 1,3-propanediol, 1,3-butanediol, 1,4-butanediol, 2,3-butanediol, diethylene glycol, triethylene glycol, 1,5-pentanediol, 1,6-hexanediol, neopentyl glycol, 2-methyl-1,3-propanediol, 2-ethyl-1,3-hexanediol, 1,4-cyclohexanedimethanol (CHDM), hydrogenated bisphenol A, a bisphenol represented by the following formula (I) or a derivative thereof:

(I)

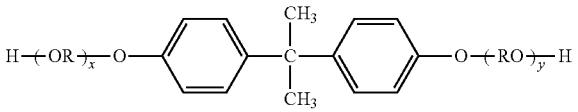

(in the formula (I), R represents an ethylene group or a propylene group, x and y each independently represent an integer of 0 or more, and the average of x+y is 0 or more and 10 or less), and a diol represented by the following formula (II):

(II)

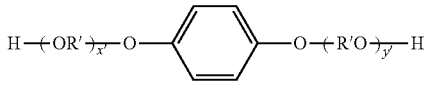

(in the formula (II), R' represents

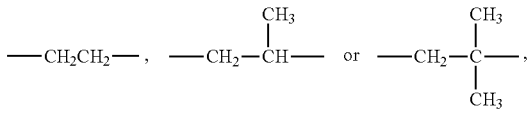

x' and y' each independently represent an integer of 0 or more, and the average of x'+y' is 0 or more and 10 or less).

As the component for forming the polyester unit according to the present invention, a trivalent or more carboxylic acid compound or a trihydric or more alcohol compound may be used in addition to the above-mentioned divalent carboxylic acid compound and dihydric alcohol compound.

Examples of the trivalent or more carboxylic acid compound include trimellitic acid, trimellitic anhydride, and pyromellitic acid. Examples of the trihydric or more alcohol compound include trimethylolpropane, pentaerythritol, and glycerin.

The alcohol component for forming the polyester unit according to the present invention contains an aliphatic polyhydric alcohol at a content of preferably 1 mol % or more and 30 mol % or less, more preferably 5 mol % or more and 30 mol % or less.

When the content of the aliphatic polyhydric alcohol is set to 1 mol % or more and 30 mol % or less, the concentration of ester groups can be increased in the polyester unit. As a result, an interaction between the ester groups and the magnetic iron oxide particle is effectively exhibited, and thus the tailing and the scattering are more suppressed.

As a production method for the polyester unit according to the present invention, there is given, for example, the following method.

First, the divalent carboxylic acid compound and the dihydric alcohol compound are loaded concurrently with the aliphatic monocarboxylic acid or the aliphatic monoalcohol. Then, those compounds are polymerized through a reaction such as an esterification reaction, an ester exchange reaction, or a condensation reaction, to thereby produce the polyester unit. The polymerization temperature preferably falls within a range of 180° C. or more and 290° C. or less. At the time of the polymerization of the polyester unit, for example, a polymerization catalyst such as a titanium-based catalyst, a tin-based catalyst, zinc acetate, antimony trioxide, or germanium dioxide may be used. In the present invention, the polyester unit is preferably one obtained through condensation polymerization in the presence of a titanium-based catalyst. The use of the titanium-based catalyst stabilizes the chargeability of the magnetic toner, and thus the tailing is more suppressed.

Examples of the titanium-based catalyst include titanium diisopropylate bistriethanolaminate $[Ti(C_6H_{14}O_3N)_2(C_3H_7O)_2]$, titanium diisopropylate bisdiethanolaminate $[Ti(C_4H_{10}O_2N)_2(C_3H_7O)_2]$, titanium dipentylate bistriethanolaminate $[Ti(C_6H_{14}O_3N)_2(C_5H_{11}O)_2]$, titanium diethylate bistriethanolaminate $[Ti(C_6H_{14}O_3N)_2(C_2H_5O)_2]$, titanium dihydroxyoctylate bistriethanolaminate $[Ti(C_6H_{14}O_3N)_2(OHC_8H_{16}O)_2]$, titanium distearate bistriethanolaminate $[Ti(C_6H_{14}O_3N)_2(C_{18}H_{37}O)_2]$, titanium triisopropylate triethanolaminate [$Ti(C_6H_{14}O_3N)_1$ $(C_3H_7O)_3$], titanium monopropylate tris(triethanolaminate) [$Ti(C_6H_{14}O_3N)_3(C_3H_7O)_1$], tetra-n-butyl titanate [$Ti(C_4H_9O)_4$] (titanium tetrabutoxide), tetrapropyl titanate [$Ti(C_3H_7O)_4$], tetrastearyl titanate [$Ti(C_{18}H_{37}O)_4$], tetramyristyl titanate [$Ti(C_{14}H_{29}O)_4$], tetraoctyl titanate [$Ti(C_8H_{17}O)_4$], dioctyl dihydroxyoctyl titanate [$Ti(C_8H_{17}O)_2$ $(OHC_8H_{16}O)_2$], and dimyristyl dioctyl titanate [$Ti(C_{14}H_{29}O)_2(C_8H_{17}O)_2$]. Of those, titanium diisopropylate bistriethanolaminate, titanium diisopropylate bisdiethanolaminate, titanium dipentylate bistriethanolaminate, tetrastearyl titanate, tetramyristyl titanate, tetraoctyl titanate, and dioctyl dihydroxyoctyl titanate are preferred.

Those titanium-based catalysts may be obtained by, for example, allowing a titanium halide and an alcohol corresponding to a target to react with each other.

In addition, the titanium-based catalyst preferably contains an aromatic carboxylic acid titanium compound.

The aromatic carboxylic acid titanium compound is preferably one obtained by allowing an aromatic carboxylic acid and a titanium alkoxide to react with each other.

The aromatic carboxylic acid is preferably a divalent or more aromatic carboxylic acid (i.e., an aromatic carboxylic acid having two or more carboxy groups) and/or an aromatic oxycarboxylic acid.

Examples of the divalent or more aromatic carboxylic acid include: dicarboxylic acids such as phthalic acid, isophthalic acid, and terephthalic acid, and anhydrides thereof; and polycarboxylic acids such as trimellitic acid, benzophenonedicarboxylic acid, benzophenonetetracarboxylic acid, naphthalenedicarboxylic acid, and naphthalenetetracarboxylic acid, and anhydrides thereof and esterified products thereof. Of those, isophthalic acid, terephthalic acid, trimellitic acid, and naphthalenedicarboxylic acid are preferred.

Examples of the aromatic oxycarboxylic acid include salicylic acid, m-oxybenzoic acid, p-oxycarboxylic acid, gallic acid, mandelic acid, and tropic acid.

The aliphatic compound according to the present invention is at least one kind selected from the group consisting of an aliphatic monocarboxylic acid having 30 or more and 102 or less carbon atoms and an aliphatic monoalcohol having 30 or more and 102 or less carbon atoms. Any one of a primary aliphatic monocarboxylic acid or aliphatic monoalcohol, a secondary aliphatic monocarboxylic acid or aliphatic monoalcohol, or a tertiary aliphatic monocarboxylic acid or aliphatic monoalcohol may be used as the aliphatic monocarboxylic acid or the aliphatic monoalcohol.

Examples of the aliphatic monocarboxylic acid include melissic acid, lacceric acid, tetracontanoic acid, and pentacontanoic acid.

Examples of the aliphatic monoalcohol include melissyl alcohol and tetracontanol.

As the aliphatic compound according to the present invention, a modified wax obtained by modifying an aliphatic hydrocarbon-based wax with an acid or an alcohol may be used.

While the modified wax may contain a zerovalent wax, a monovalent wax, or a divalent or more wax, it is preferred that a mixture of modified waxes contain a monovalent modified wax (monocarboxylic acid or monoalcohol) at a content of 40 mass % or more. It is more preferred that the monovalent modified wax be contained at a content of 50 mass % or more.

An example of the acid-modified aliphatic hydrocarbon-based wax is an acid-modified wax obtained by modifying polyethylene or polypropylene with an unsaturated monovalent carboxylic acid such as acrylic acid. The melting point of the acid-modified wax may be controlled by its molecular weight.

Of the alcohol-modified aliphatic hydrocarbon-based waxes, a primary alcohol-modified aliphatic hydrocarbon-based wax may be produced by, for example, the following method. First, ethylene is polymerized by using a Ziegler catalyst, to obtain polyethylene. After the completion of the polymerization, an alkoxide between a catalyst metal and polyethylene is formed through oxidation, followed by hydrolysis, to thereby produce the primary alcohol-modified aliphatic hydrocarbon-based wax.

Of the alcohol-modified aliphatic hydrocarbon-based waxes, a secondary alcohol-modified aliphatic hydrocarbon-based wax may be produced by, for example, the following method. The secondary alcohol-modified aliphatic hydrocarbon-based wax is obtained through liquid-phase oxidation of an aliphatic hydrocarbon-based wax using a molecular oxygen-containing gas in the presence of boric acid and boric anhydride. Further, the obtained secondary alcohol-modified aliphatic hydrocarbon-based wax may be subjected to purification by a press sweating method, purification using a solvent, hydrogenation treatment, treatment with activated clay after washed with sulfuric acid, or the like. As a catalyst, a mixture of boric acid and boric anhydride may be used. The molar ratio of boric acid to boric anhydride (boric acid/boric anhydride) is preferably 1.0/1.0 or more and 2.0/1.0 or less, more preferably 1.2/1.0 or more and 1.7/1.0 or less. As the ratio of boric anhydride becomes larger, an agglomeration phenomenon due to excessive boric acid is less liable to occur. As the ratio of boric anhydride becomes smaller, the amount of a substance in a powder form derived from boric anhydride generated after the reaction becomes smaller. In addition, boric anhydride, which makes less contribution to the reaction, is more reduced.

The amount of the mixture of boric acid and boric anhydride to be used, in an amount of the mixture converted into boric acid, is preferably 0.001 mole or more and 10 moles or less, more preferably 0.1 mole or more and 1 mole or less with respect to 1 mole of an aliphatic hydrocarbon-based wax serving as a raw material.

For example, metaboric acid and pyroboric acid are given as a catalyst other than boric acid/boric anhydride.

In addition, for example, an oxygen acid of boron, an oxygen acid of phosphorus, and an oxygen acid of sulfur are given as an acid that forms an ester with an alcohol. More specifically, for example, boric acid, nitric acid, phosphoric acid, and sulfuric acid are given.

Examples of the molecular oxygen-containing gas include an oxygen gas, air, and a gas obtained by diluting those gases with an inert gas. The molecular oxygen-containing gas has an oxygen concentration of preferably 1 vol % or more and 30 vol % or less, more preferably 3 vol % or more and 20 vol % or less.

The liquid-phase oxidation reaction is generally conducted in a melting state of the aliphatic hydrocarbon-based wax serving as a raw material without using a solvent. The reaction temperature is preferably 120° C. or more and 280° C. or less, more preferably 150° C. or more and 250° C. or less. The reaction time period is preferably 1 hour or more and 15 hours or less.

Boric acid and boric anhydride are preferably mixed in advance, and added to a reaction system. Boric acid hardly undergoes a dehydration reaction when boric acid and boric anhydride are mixed in advance.

The addition temperature of the mixed catalyst of boric acid and boric anhydride (a temperature at which the mixed catalyst is added to the reaction system) is preferably 100° C. or more and 180° C. or less, more preferably 110° C. or more and 160° C. or less. When the addition temperature is 100° C. or more, moisture hardly remains in the reaction system, and a reduction in catalytic function of boric anhydride due to the moisture hardly occurs.

After the completion of the reaction, water is added to the reaction mixture, to hydrolyze a generated boric acid ester of the aliphatic hydrocarbon-based wax, followed by purification. Thus, the alcohol-modified aliphatic hydrocarbon-based wax is obtained.

As the aliphatic compound according to the present invention, the aliphatic monocarboxylic acid having or more and 102 or less carbon atoms and/or the aliphatic monoalcohol having 30 or more and 102 or less carbon atoms is used. Of those, the aliphatic monoalcohol having 30 or more and 102 or less carbon atoms is preferred. Of the aliphatic monoalcohols, the alcohol-modified aliphatic hydrocarbon-based wax is more preferred from the viewpoint of the low-temperature fixability.

In addition, as a method of condensing the aliphatic compound at an end of the polyester unit, there is given, for example, the following method: a method involving adding the aliphatic compound together with monomers for forming the polyester unit in the resin during the production of the resin having a polyester unit (polyester resin), to conduct condensation polymerization. By the method, the aliphatic compound can be more uniformly condensed at an end of the polyester unit in the resin. As a result, the dispersibility of the magnetic iron oxide particles is more improved.

The amount of the aliphatic compound to be used is preferably 0.10 part by mass or more and 10 parts by mass or less with respect to 100 parts by mass of the total mass of monomers for forming the resin having a polyester unit in which the aliphatic compound is condensed at an end of the polyester unit. The amount of the aliphatic compound to be used is more preferably 1 part by mass or more and 5 parts by mass or less. When the amount of the aliphatic compound falls within the above-mentioned range, the carbon chains derived from the aliphatic compound more effectively serve as the soft segments in the binder resin, and the low-temperature fixability of the magnetic toner is more improved.

In the binder resin in the toner particle according to the present invention, a resin other than the resin having the polyester unit may be concurrently used. As the other resin, a polyester resin or a hybrid resin in which a polyester unit and another polymer unit are chemically bonded to each other is preferred with a view to sufficiently obtaining the effects of the present invention.

It is preferred that also the resin other than the resin having the polyester unit be a resin having a polyester unit in which an aliphatic compound similar to the above-mentioned aliphatic compound is condensed at an end of the polyester unit. When a moiety derived from the aliphatic compound is present also in the resin other than the resin having the polyester unit, the compatibility between the resins is enhanced.

In the case of concurrently using the resin other than the resin having the polyester unit, the resin other than the resin having the polyester unit is preferably used so that the content of the polyester unit is 20 mass % or more with respect to the binder resin. When the content of the polyester unit is 20 mass % or more with respect to the binder resin, the magnetic iron oxide particles can be dispersed in an entirely uniform state, without being unevenly distributed in part of the toner particles. As a result, the magnetic iron oxide particles exhibit more satisfactory dispersibility in the toner particles, and thus the variations in the electrical resistance in the toner particles are more suppressed. In consequence, the transfer penetration is less liable to occur, resulting in less coarseness. In addition, the magnetic iron oxide particles are dispersed in a more uniform state, and thus a magnetic brush is more uniformly formed on the toner carrying member. In consequence, the tailing and the scattering are more suppressed, and the fogging is more suppressed.

In a system using as the binder resin a plurality of resins in combination, a high-softening point resin preferably has a softening point (Tm) of 115° C. or more and 170° C. or less. In addition, a low-softening point resin preferably has a softening point (Tm) of 70° C. or more and less than 110° C.

The combination use of a plurality of resins having different softening points as the binder resin is preferred, because such combination use enables easy design of the molecular weight distribution of the binder resin in the toner particles, and enables a wide fixation region.

The mixing ratio of the low-softening point resin to the high-softening point resin (low-softening point resin/high-softening point resin) is preferably 20/80 or more and 80/20 or less.

In the case of using as the binder resin the plurality of resins having different softening points in combination, it is preferred that the low-softening point resin and the high-softening point resin be each the resin having a polyester unit in which the aliphatic compound is condensed at an end of the polyester unit. Further, it is more preferred that the average value of the carbon number of the aliphatic compound in association with the high-softening point resin be smaller than the average value of the carbon number of the aliphatic compound in association with the low-softening point resin. As the carbon number of the aliphatic compound is smaller, the carbon chains derived from the aliphatic compound more easily move. That is, a softer structure is achieved. Therefore, by using the aliphatic compound allowing a softer structure in the high-softening point resin, the binder resin has satisfactory softness balance as a whole, and the magnetic iron oxide particles have more satisfactory dispersibility in the binder resin and then in the toner particles. As a result, the variations in the electrical resistance in the toner particles are more suppressed, and the transfer penetration is less liable to occur, resulting in less coarseness. In addition, the magnetic iron oxide particles are more uniformly dispersed, and thus a magnetic brush is more uniformly formed on the toner carrying member. In consequence, the tailing and the scattering are more suppressed, and the fogging is more suppressed.

In addition, in the case where the low-softening point resin and the high-softening point resin are each the resin having a polyester unit in which the aliphatic compound is condensed at an end of the polyester unit, the aliphatic compound in association with the low-softening point resin is preferably the primary alcohol-modified aliphatic hydrocarbon-based wax. The aliphatic compound in association with the high-softening point resin is preferably the secondary alcohol-modified aliphatic hydrocarbon-based wax. With such configuration, the low-temperature fixability of the magnetic toner is more improved.

In the case of using as the binder resin one kind of resin alone, the resin has a softening point (Tm) of preferably 95° C. or more and 170° C. or less, more preferably 110° C. or more and 160° C. or less.

The binder resin preferably has a glass transition temperature (Tg) of 45° C. or more from the viewpoint of the storage stability of the magnetic toner. In addition, the binder resin has a glass transition temperature (Tg) of preferably 75° C. or less, more preferably 65° C. or less from the viewpoint of the low-temperature fixability.

In the case of using as the resin having a polyester unit a hybrid resin in which the polyester unit and the vinyl-based polymer unit are chemically bonded to each other, it is preferred to use at least styrene as a vinyl-based monomer for forming the vinyl-based polymer unit. Styrene is preferred because styrene easily causes a viscosity gradient in the resin by virtue of a higher ratio of an aromatic ring in its molecular structure, and enables a wide fixation region. The content of styrene in the vinyl-based monomer is preferably 70 mass % or more, more preferably 85 mass % or more.

Examples of the vinyl-based monomer include a styrene-based monomer and a (meth)acrylic acid-based monomer.

Examples of the styrene-based monomer include: styrene; and derivatives of styrene, such as o-methylstyrene, m-methylstyrene, p-methylstyrene, p-phenylstyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, p-methoxystyrene, p-chlorostyrene, 3,4-dichlorostyrene, m-nitrostyrene, o-nitrostyrene, and p-nitrostyrene.

Examples of the (meth)acrylic acid-based monomer include: acrylic acid and acrylic acid esters, such as acrylic acid, methyl acrylate, ethyl acrylate, propyl acrylate, n-butyl acrylate, isobutyl acrylate, n-octyl acrylate, dodecyl acrylate, 2-ethylhexyl acrylate, stearyl acrylate, 2-chloroethyl acrylate, and phenyl acrylate; methacrylic acid and methacrylic acid esters, such as methacrylic acid, methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate, and diethylaminoethyl methacrylate; and acrylic acid or methacrylic acid derivatives such as acrylonitrile, methacrylonitrile, and acrylamide.

In addition, further examples of the monomer for forming the vinyl-based polymer unit include: acrylic acid or methacrylic acid esters such as 2-hydroxy-ethyl acrylate, 2-hydroxy-ethyl methacrylate, and 2-hydroxy-propyl methacrylate; and monomers each having a hydroxy group such as 4-(1-hydroxy-1-methylbutyl)styrene and 4-(1-hydroxy-1-methylhexyl)styrene.

A monomer that may be subjected to vinyl polymerization other than the above-mentioned monomers may also be used for the vinyl-based polymer unit.

Examples of the monomer that may be subjected to vinyl polymerization other than the above-mentioned monomers include: ethylenically unsaturated monoolefins such as ethylene, propylene, butylene, and isobutylene; unsaturated polyenes such as butadiene and isoprene; vinyl halides such as vinyl chloride, vinylidene chloride, vinyl bromide, and vinyl fluoride; vinyl esters such as vinyl acetate, vinyl propionate, and vinyl benzoate; vinyl ethers such as vinyl methyl ether, vinyl ethyl ether, and vinyl isobutyl ether; vinyl ketones such as vinyl methyl ketone, vinyl hexyl ketone, and methyl isopropenyl ketone; N-vinyl compounds such as N-vinylpyrrole, N-vinylcarbazole, N-vinylindole, and N-vinylpyrrolidone; vinylnaphthalenes; unsaturated dibasic acids such as maleic acid, citraconic acid, itaconic acid, alkenylsuccinic acid, fumaric acid, and mesaconic acid; unsaturated dibasic acid anhydrides such as maleic anhydride, citraconic anhydride, itaconic anhydride, and an alkenylsuccinic anhydride; unsaturated dibasic acid half esters such as methyl maleate half ester, ethyl maleate half ester, butyl maleate half ester, methyl citraconate half ester, ethyl citraconate half ester, butyl citraconate half ester, methyl itaconate half ester, a methyl alkenylsuccinate half ester, methyl fumarate half ester, and methyl mesaconate half ester; unsaturated dibasic acid esters such as dimethyl maleate and dimethyl fumarate; acid anhydrides of α,β-unsaturated acids such as acrylic acid, methacrylic acid, crotonic acid, and cinnamic acid; anhydrides of α,β-unsaturated acids and lower fatty acids; and monomers each having a carboxyl group such as an alkenylmalonic acid, an alkenylglutaric acid, and an alkenyladipic acid, and acid anhydrides thereof and monoesters thereof.

In addition, a crosslinkable monomer may be used as the vinyl-based polymer unit.

Examples of the crosslinkable monomer include an aromatic divinyl compound, a diacrylate compound bonded by an alkyl chain, a diacrylate compound bonded by an alkyl chain containing an ether bond, a diacrylate compound bonded by a chain containing an aromatic group and an ether bond, a polyester-type diacrylate, and a polyfunctional crosslinking agent.

Examples of the aromatic divinyl compound include divinylbenzene and divinylnaphthalene.

Examples of the diacrylate compound bonded by an alkyl chain include ethylene glycol diacrylate, 1,3-butylene glycol diacrylate, 1,4-butanediol diacrylate, 1,5-pentanediol diacrylate, 1,6-hexanediol diacrylate, neopentyl glycol diacrylate, ethylene glycol dimethacrylate, 1,3-butylene glycol dimethacrylate, 1,4-butanediol dimethacrylate, 1,5-pentanediol dimethacrylate, 1,6-hexanediol dimethacrylate, and neopentyl glycol dimethacrylate.

Examples of the diacrylate compound bonded by an alkyl chain containing an ether bond include diethylene glycol diacrylate, triethylene glycol diacrylate, tetraethylene glycol diacrylate, polyethylene glycol #400 diacrylate, polyethylene glycol #600 diacrylate, dipropylene glycol diacrylate, diethylene glycol dimethacrylate, triethylene glycol dimethacrylate, tetraethylene glycol dimethacrylate, polyethylene glycol #400 dimethacrylate, polyethylene glycol #600 dimethacrylate, and dipropylene glycol dimethacrylate.

Examples of the diacrylate compound bonded by a chain containing an aromatic group and an ether bond include polyoxyethylene(2)-2,2-bis(4-hydroxyphenyl)propane diacrylate, polyoxyethylene(4)-2,2-bis(4-hydroxyphenyl)propane diacrylate, polyoxyethylene(2)-2,2-bis(4-hydroxyphenyl)propane dimethacrylate, and polyoxyethylene(4)-2,2-bis(4-hydroxyphenyl)propane dimethacrylate.

An example of the polyester-type diacrylate is MANDA (trade name) manufactured by Nippon Kayaku Co., Ltd.

Examples of the polyfunctional crosslinking agent include pentaerythritol triacrylate, trimethylolethane triacrylate, trimethylolpropane triacrylate, tetramethylolmethane tetraacrylate, oligoester acrylate, pentaerythritol trimethacrylate, trimethylolethane trimethacrylate, trimethylolpropane trimethacrylate, tetramethylolmethane tetramethacrylate, oligoester methacrylate, triallyl cyanurate, and triallyl trimellitate.

The vinyl-based polymer unit may be a polymer produced by using a polymerization initiator. The amount of the polymerization initiator to be used is preferably 0.05 part by mass or more and 10 parts by mass or less with respect to 100 parts by mass of the vinyl-based monomer from the viewpoint of polymerization efficiency.

Examples of the polymerization initiator include 2,2'-azobisisobutyronitrile, 2,2'-azobis(4-methoxy-2,4-dimethylvaleronitrile), 2,2'-azobis(2,4-dimethylvaleronitrile), 2,2'-azobis(2-methylbutyronitrile), dimethyl-2,2'-azobisisobutyrate, 1,1'-azobis(1-cyclohexanecarbonitrile), 2-carbamoylazo-isobutyronitrile, 2,2'-azobis(2,4,4-trimethylpentane), 2-phenylazo-2,4-dimethyl-4-methoxyvaleronitrile, 2,2'-azobis(2-methylpropane), ketone peroxides such as methyl ethyl ketone peroxide, acetylacetone peroxide, and cyclohexanone peroxide, 2,2-bis(t-butylperoxy)butane, t-butyl hydroperoxide, cumene hydroperoxide, 1,1,3,3-tetramethylbutyl hydroperoxide, di-t-butyl peroxide, t-butyl cumyl peroxide, dicumyl peroxide, α,α'-bis(t-butylperoxyisopropyl)benzene, isobutyl peroxide, octanoyl peroxide, decanoyl peroxide, lauroyl peroxide, 3,5,5-trimethylhexanoyl peroxide, benzoyl peroxide, m-trioyl peroxide, diisopropyl peroxydicarbonate, di-2-ethylhexyl peroxydicarbonate, di-n-propyl peroxydicarbonate, di-2-ethoxyethyl peroxycarbonate, dimethoxyisopropyl peroxydicarbonate, di(3-methyl-3-methoxybutyl) peroxycarbonate, acetyl cyclohexylsulfonyl peroxide, t-butyl peroxyacetate, t-butyl peroxyisobutyrate, t-butyl peroxyneodecanoate, t-butyl peroxy-2-ethylhexanoate, t-butyl peroxylaurate, t-butyl peroxybenzoate, t-butylperoxyisopropyl carbonate, di-t-butyl peroxyisophthalate, t-butyl peroxyallylcarbonate, t-amyl peroxy-2-ethylhexanoate, di-t-butyl peroxyhexahydroterephthalate, and di-t-butyl peroxyazelate.

The hybrid resin in which the polyester unit and the vinyl-based polymer unit are chemically bonded to each other is preferably produced through polymerization using a compound capable of reacting with the monomers for forming the respective polymer units (hereinafter also referred to as "dual-reactive compound").

Examples of the dual-reactive compound include fumaric acid, acrylic acid, methacrylic acid, citraconic acid, maleic acid, and dimethyl fumarate. Of those, fumaric acid, acrylic acid, and methacrylic acid are preferred.

As a production method for the hybrid resin in which the polyester unit and the vinyl-based polymer unit are chemically bonded to each other, there is given, for example, the following method.

Specifically, the hybrid resin may be produced by allowing the monomers for forming the polyester unit and the monomer for forming the vinyl-based polymer unit to react at the same time, or by allowing the monomers to react in sequence. The molecular weight of the hybrid resin is easily controlled by subjecting a vinyl-based copolymer monomer to an addition polymerization reaction, followed by subjecting the monomers for forming the polyester unit to a condensation polymerization reaction.

The amount of the dual-reactive compound to be used is preferably 0.1 mass % or more and 20.0 mass % or less, more preferably 0.2 mass % or more and 10.0 mass % or less with respect to the vinyl-based monomer.

The toner particle preferably contains a release agent (wax) in order to impart releasability to the magnetic toner.

The release agent (wax) is preferably Fischer-Tropsch wax from the viewpoints of dispersibility in the toner particle and releasability. In addition, a hydrocarbon-based wax other than the Fischer-Tropsch wax may also be used. Examples of the hydrocarbon-based wax include low molecular weight polyethylene, low molecular weight polypropylene, microcrystalline wax, and paraffin wax.

One kind of the release agents (wax) may be used alone, or two or more kinds thereof may be used in combination.

In the case of producing the toner particles by a kneading pulverization method, the release agent (wax) may be added in a kneading step (melt-kneading step), or in a production step of the binder resin in the toner particles.

The content of the release agent (wax) in the toner particle is preferably 1 part by mass or more and 20 parts by mass or less with respect to 100 parts by mass of the binder resin in the toner particle. When the content of the release agent falls within the above-mentioned range, the release agent achieves high releasability, and satisfactory dispersibility in the toner particles. Thus, the magnetic toner hardly adheres onto the electrostatic latent image bearing member, and the surface of a cleaning member is hardly contaminated.

The toner particle according to the present invention preferably contains a charge control agent in order to stabilize the charging characteristics of the magnetic toner.

The content of the charge control agent in the toner particle is preferably 0.1 part by mass or more and 10 parts by mass or less, more preferably 0.1 part by mass or more and 5 parts by mass or less with respect to 100 parts by mass of the binder resin in the toner particle.

One kind of the charge control agents may be used alone, or two or more kinds thereof may be used in combination.

As a substance that controls the magnetic toner so as to impart negative chargeability as the charge control agent, there are given, for example, a monoazo metal complex or metal salt, an acetylacetone metal complex or metal salt, an aromatic hydroxycarboxylic acid metal complex or metal salt, an aromatic dicarboxylic acid metal complex or metal salt, an aromatic monocarboxylic acid or polycarboxylic acid, and metal salt thereof and an anhydride thereof, an ester, and a phenol derivative such as bisphenol. Of those, a monoazo metal complex or metal salt, which offers highly stable charging characteristics, is preferred.

In addition, a charge control resin may be used as the charge control agent, and the charge control resin may be used in combination with the charge control agent other than a resin.

Examples of the charge control resin include a sulfur-containing polymer and sulfur-containing copolymer produced by the following method.

A preferred production method for the sulfur-containing polymer and the sulfur-containing copolymer is a production method involving employing a bulk polymerization method or solution polymerization method without using a reaction solvent (polymerization solvent) or with using the reaction solvent (polymerization solvent) in a small amount.

Examples of the reaction solvent include methanol, ethanol, propanol, 2-propanol, propanone, 2-butanone, and dioxane. Of those, a mixed solvent of methanol, 2-butanone, and 2-propanol is preferred, and the mass ratio among methanol, 2-butanone, and 2-propanol (methanol:2-butanone:2-propanol) is preferably from 2:1:1 to 1:5:5.

As a polymerization initiator in producing the sulfur-containing polymer or the sulfur-containing copolymer, there are given, for example, t-butyl peroxy-2-ethylhexanoate, cumyl perpivalate, t-butyl peroxylaurate, benzoyl peroxide, lauroyl peroxide, octanoyl peroxide, di-t-butyl peroxide, t-butyl cumyl peroxide, dicumyl peroxide, 2,2'-azobisisobutyronitrile, 2,2'-azobis(2-methylbutyronitrile), 2,2'-azobis(2,4-dimethylvaleronitrile), 2,2'-azobis(4-methoxy-2,4-dimethylvaleronitrile), 4,4'-azobis-4-cyanovaleric acid, 1,1'-azobis(cyclohexane-1-carbonitrile), 1,1'-di(t-butylperoxy)3-methylcyclohexane, 1,1-bis(t-butylperoxy)3,3,5-trimethylcyclohexane, 1,1'-di(t-butylperoxy)3,3,5-trimethylcyclohexane, 1,1-bis(t-butylperoxy)cyclohexane, 1,4-bis(t-butylperoxycarbonyl)

cyclohexane, 2,2-bis(t-butylperoxy)octane, n-butyl-4,4-bis(t-butylperoxy)valerate, 2,2-bis(t-butylperoxy)butane, 1,3-bis(t-butylperoxy-isopropyl)benzene, 2,5-dimethyl-2,5-di(t-butylperoxy)hexane, 2,5-dimethyl-2,5-di(t-butylperoxy)hexane, 2,5-dimethyl-2,5-di(benzoylperoxy)hexane, di-t-butyl diperoxyisophthalate, 2,2-bis(4,4-di-t-butylperoxycyclohexyl)propane, di-t-butyl peroxy-α-methylsuccinate, di-t-butyl peroxydimethylglutarate, di-t-butyl peroxyhexahydroterephthalate, di-t-butyl peroxyazelate, 2,5-dimethyl-2,5-di(t-butylperoxy)hexane, diethylene glycol-bis(t-butylperoxycarbonate), di-t-butyl peroxytrimethyladipate, tris(t-butylperoxy)triazine, and vinyltris(t-butylperoxy)silane. One kind of the polymerization initiators may be used alone, or two or more kinds thereof may be used in combination. Of those, one or more kinds among the following polymerization initiators are preferably used: 2,2'-azobis(2-methylbutyronitrile), 4,4'-azobis-4-cyanovaleric acid, 1,1'-di(t-butylperoxy)3-methylcyclohexane, and 1,1-bis(t-butylperoxy)3,3,5-trimethylcyclohexane. Those polymerization initiators are preferred because such polymerization initiators facilitate adjustment of the molecular weight of the sulfur-containing polymer or sulfur-containing copolymer in a preferred range, reduce an unreacted monomer, and enhance a polymerization conversion rate.

As a substance that controls the magnetic toner so as to impart positive chargeability as the charge control agent, there are given, for example: nigrosin and a modified product thereof with a fatty acid metal salt; quaternary ammonium salts such as tributylbenzylammonium 1-hydroxy-4-naphthosulfonate salt and tetrabutylammonium tetrafluoroborate, and analogs thereof; an onium salt such as a phosphonium salt and a lake pigment thereof (as a laking agent, there are given, for example, phosphotungstic acid, phosphomolybdic acid, phosphotungstomolybdic acid, tannic acid, lauric acid, gallic acid, ferricyanic acid, and a ferrocyanide compound); a triphenylmethane dye and a lake pigment thereof (as a laking agent, there are given, for example, phosphotungstic acid, phosphomolybdic acid, phosphotungstomolybdic acid, tannic acid, lauric acid, gallic acid, ferricyanic acid, and a ferrocyanide compound); and a metal salt of a higher fatty acid. Of those, nigrosin, a modified product of nigrosin with an fatty acid metal salt, and a quaternary ammonium salt are preferred.

One kind of the charge control agents (including the charge control resin) may be used alone, or two or more kinds thereof may be used in combination.

The toner of the present invention preferably has added therein a flowability improver having a small number-average particle diameter of primary particles and thus having a high flowability imparting ability to the surfaces of the toner particles. As the flowability improver, an improver that is externally added to the toner particle and can increase the flowability as compared to that before its addition is preferred.

Examples of the flowability improver include: fluorine-based resin particles such as vinylidene fluoride fine particles and polytetrafluoroethylene fine particles; silica fine particles such as wet-process silica fine particles and dry-process silica fine particles; treated silica fine particles obtained by subjecting silica fine particles to surface treatment with a treatment agent such as a silane coupling agent, a titanium coupling agent, or silicone oil; titanium oxide fine particles; treated titanium oxide fine particles obtained by subjecting titanium oxide fine particles to surface treatment with a treatment agent such as a silane coupling agent, a titanium coupling agent, or silicone oil; alumina fine particles; and treated alumina fine particles obtained by subjecting alumina fine particles to surface treatment with a treatment agent such as a silane coupling agent, a titanium coupling agent, or silicone oil.

The flowability improver preferably has a specific surface area measured by a BET method using nitrogen adsorption (BET specific surface area) of preferably 30 $m^2/g$ or more, more preferably 50 $m^2/g$ or more and 300 $m^2/g$ or less.

The flowability improver is added in an amount of preferably 0.01 part by mass or more and 8.0 parts by mass or less, more preferably 0.1 part by mass or more and 4.0 parts by mass or less with respect to 100 parts by mass of the toner particles.

Any other external additive may be externally added (added) to the toner of the present invention as required. Examples of the other external additive include resin fine particles and inorganic fine particles serving as charging adjuvants, conductivity-imparting agents, caking inhibitors, release agents for fixation using a heat roller, or abrasives.

Examples of the abrasive include cerium oxide particles, silicon carbide particles, and strontium titanate particles.

The toner may be obtained by mixing those external additives with the toner particles by using a mixer such as a Henschel mixer.

An example of a production method for the toner of the present invention by a pulverization method (kneading pulverization method) is hereinafter described.

First, the binder resin and the magnetic iron oxide particles, and as required, the release agent (wax), a colorant, and other additives are mixed with a mixer such as a Henschel mixer or a ball mill, to obtain a mixture. Then, the mixture is melt-kneaded with a heat kneader such as a heat roll, a kneader, or an extruder, to obtain a kneaded product (melt-kneaded product). Next, the melt-kneaded product is cooled to be solidified. Then, the kneaded product is pulverized with a pulverizer, followed by being classified with a classifier. Thus, the toner particles are obtained. As required, the flowability improver such as the silica fine particles may be mixed with the toner particles by using a mixer such as a Henschel mixer, to thereby obtain the toner in which the flowability improver is externally added (added) to the toner particles.

Examples of the mixer include: Henschel mixer (trade name) manufactured by Nippon Coke & Engineering Co., Ltd. (formerly, Mitsui Mining Co., Ltd.); SUPERMIXER (trade name) manufactured by Kawata Mfg Co., Ltd.; RIBOCONE (trade name) manufactured by Okawara Mfg. Co., Ltd.; Nauta mixer (trade name), Turbulizer (trade name), and Cyclomix (trade name) manufactured by Hosokawa Micron Corporation; Spiral Pin Mixer (trade name) manufactured by Pacific Machinery & Engineering Co., Ltd.; and Loedige Mixer (trade name) manufactured by MATSUBO Corporation.

Examples of the kneader include: KRC Kneader (trade name) manufactured by Kurimoto, Ltd.; Buss Co-Kneader (trade name) manufactured by Buss; a TEM (trade name)-type extruder manufactured by Toshiba Machine Co., LTD.; a twin screw kneader "TEX" (trade name) manufactured by The Japan Steel Works, LTD.; PCM extruder (trade name) manufactured by Ikegai Corp (formerly, Ikegai Ironworks Corp); THREE ROLL MILL (trade name), MIXING ROLL MILL (trade name), and Kneader (trade name) manufactured by Inoue Mfg., Inc.; KNEADEX (trade name) manufactured by Nippon Coke & Engineering Co., Ltd. (formerly, Mitsui Mining Co., Ltd.); MS TYPE DISPERSION MIXER (trade name), KNEADER-RUDER (trade name) manufactured by Moriyama Company Ltd.; and BANBURY Mixer (trade name) manufactured by Kobe Steel, Ltd.

Examples of the pulverizer include: Counter Jet Mill (trade name), Micron Jet (trade name), and Innomizer (trade name) manufactured by Hosokawa Micron Corporation; IDS-type Mill (trade name) and Jet Mill PJM (trade name) manufactured by Nippon Pneumatic Mfg. Co., Ltd.; Cross Jet Mill (trade name) manufactured by Kurimoto, Ltd.; ULMAX (trade name) manufactured by Nisso Engineering Co., Ltd.; SK Jet-O-Mill (trade name) manufactured by Seishin Enterprise Co., Ltd.; Kryptron (trade name) manufactured by Kawasaki Heavy Industries, Ltd.; and Turbo Mill (trade name) manufactured by Freund-Turbo Corporation; and SUPER ROTOR (trade name) manufactured by Nisshin Engineering Inc.

Examples of the classifier include: Classiel (trade name), Micron Classifier (trade name), and Spedic Classifier (trade name) manufactured by Seishin Enterprise Co., Ltd.; TURBO CLASSIFIER (trade name) manufactured by Nisshin Engineering Inc.; Micron Separator (trade name), Turboplex (ATP) (trade name), TSP Separator (trade name), and TTSP Separator (trade name) manufactured by Hosokawa Micron Corporation; Elbow-Jet (trade name) manufactured by Nittetsu Mining Co., Ltd.; Dispersion Separator (trade name) manufactured by Nippon Pneumatic Mfg. Co., Ltd.; and YM Micro Cut (trade name) manufactured by Yasukawa Shoji K.K.

As a sieving apparatus to be used for sieving coarse particles, there are given, for example: Ultrasonic (trade name) manufactured by Koei Sangyo Co., Ltd.; Resonasieve (trade name) and Gyro-Sifter (trade name) manufactured by Tokuju Corporation; Vibrasonic System (trade name) manufactured by Dalton Corporation; Soniclean (trade name) manufactured by Sintokogio, Ltd.; Turbo Screener (trade name) manufactured by Freund-Turbo Corporation; MICROSHIFTER (trade name) manufactured by Makino Mfg. Co. Ltd.; and Round Vibration Sifter.

Next, measurement methods for the physical properties according to the present invention are described.

<1> Measurement of Shape, Number-Based Median Diameter D50, and Number-Based Particle Size Distribution of Magnetic Iron Oxide Particle The shapes, number-based median diameter D50, number-based D10, and number-based D90 of the magnetic iron oxide particles were measured through observation of the magnetic iron oxide particles with a scanning electron microscope 5-4800 (trade name) manufactured by Hitachi High-Technologies Corporation. The number-based particle diameters of the magnetic iron oxide particles were obtained as follows: 300 pieces of the primary particles of the magnetic iron oxide particles were each measured for its long axis and short axis based on an electron micrograph; the average of the two lengths (i.e. long axis and short axis) was defined as the diameter of the respective particles; and the number-based particle diameters were calculated from the obtained values. It is noted that in the electron micrograph, when a primary particle of the magnetic iron oxide particle is sandwiched by two straight parallel lines, the distance between the two straight parallel lines in the case that the distance between the two straight parallel lines is largest is defined as "long axis", and the distance between the two straight parallel lines in the case that the distance between the two straight parallel lines is smallest is defined as "short axis".

The magnetic iron oxide particles contained in the toner particles of the magnetic toner may be isolated by dissolving the toner particles in tetrahydrofuran to obtain a solution, followed by taking only the magnetic iron oxide particles from the solution by using a magnet.

<2> Oxidation Reaction Rate

The oxidation reaction rate of the ferrous salt in each of the first reaction step and the second reaction step was calculated based on the following equation through measurement of the content of $Fe^{2+}$ in the reaction solution.

$$(\alpha-\beta)/\alpha\times100=\text{oxidation reaction rate (\%)}$$

In the equation, $\alpha$ represents the content of $Fe^{2+}$in the reaction solution immediately after the mixing of the ferrous salt aqueous solution and the alkaline aqueous solution. $\beta$ represents the content of $Fe^{2+}$ in the ferrous salt reaction solution containing a mixture of ferrous hydroxide and the magnetite particles.

<3> Amount (Total Amount) of Silicon Atoms and Amount (Total Amount) of Aluminum Atoms in Magnetic Iron Oxide Particles The amount of silicon atoms and the amount of aluminum atoms in the magnetic iron oxide particles were each measured with an X-ray fluorescence spectrometer RIX-2100 (trade name) manufactured by Rigaku Corporation, and determined as a value in terms of elemental amount in the magnetic iron oxide particles. The amount of silicon atoms is defined as a content E (atomic %) and the amount of aluminum atoms is defined as a content F (atomic %). Both the amounts are ratios (contents) with respect to iron atoms in the magnetic iron oxide particles ((Si/Fe)×100 (atomic %) and (Al/Fe)×100 (atomic %)).

<4> Amount of Eluted Silicon Atoms a when Silicon Atoms Present in Surface of Magnetic Iron Oxide Particle are Eluted with Hydrochloric Acid (Amount of Silicon Atoms a Present in Surface of Magnetic Iron Oxide Particle), and Amount of Eluted Aluminum Atoms C when Aluminum Atoms Present in Surface of Magnetic Iron Oxide Particle are Eluted with Hydrochloric Acid (Amount of Aluminum Atoms C Present in Surface of Magnetic Iron Oxide Particle)

The amount of silicon atoms A and the amount of aluminum atoms C were measured by the following operation.

30 g of the magnetic iron oxide particles were suspended in 3 L of 3 mol/L hydrochloric acid, to obtain a suspension of the magnetic iron oxide particles. Next, while the temperature of the suspension was kept at 50° C., the suspension was sampled at constant time intervals until the magnetic iron oxide particles were entirely dissolved. The sampled suspension was filtered with a membrane filter, to obtain a filtrate. The filtrate was subjected to quantitative determination for iron atoms, silicon atoms, and aluminum atoms with an inductively-coupled plasma atomic emission spectrophotometer (trade name: ICP-S2000) manufactured by Shimadzu Corporation. The elution rate of iron atoms, the elution rate of silicon atoms, and the elution rate of aluminum atoms were calculated based on the following equations. In addition, the concentration of silicon atoms (mg/L) at the time when the magnetic iron oxide particles were completely dissolved was defined as G (mg/L).

Elution rate of iron atoms (%)={concentration of iron atoms (mg/L) in each sample/concentration of iron atoms (mg/L) at the time when magnetic iron oxide particles are completely dissolved}×100

Elution rate of silicon atoms (%)={concentration of silicon atoms (mg/L) in each sample/concentration of silicon atoms (mg/L) at the time when magnetic iron oxide particles are completely dissolved}×100

Elution rate of aluminum atoms (%)={concentration of aluminum atoms (mg/L) in each sample/concentration of aluminum atoms (mg/L) at the time when magnetic iron oxide particles are completely dissolved}×100

The elution rate of silicon atoms and the elution rate of aluminum atoms were measured at the time when the elution rate of iron atoms was 1%, 5%, and 10%. The elution rate of silicon atoms and the elution rate of aluminum atoms at the time when the elution rate of iron atoms was 0% were each calculated based on linear approximation using the measured values at three points. The amount of eluted silicon atoms A when the silicon atoms present in the surfaces of the magnetic iron oxide particles were eluted with hydrochloric acid (the amount of silicon atoms A present in the surfaces of the magnetic iron oxide particles), and the amount of eluted aluminum atoms C when the aluminum atoms present in the surfaces of the magnetic iron oxide particles were eluted with hydrochloric acid (the amount of aluminum atoms C present in the surfaces of the magnetic iron oxide particles) were each determined by using the calculated value based on the following equation.

Amount of eluted silicon atoms A (atomic %) when silicon atoms present in surfaces of magnetic iron oxide particles are eluted with hydrochloric acid={(elution rate of silicon atoms at the time when elution rate of iron atoms is 0%)×(content E (atomic %) measured with X-ray fluorescence spectrometer RIX-2100)}/100

Amount of aluminum atoms C (atomic %) present in surfaces of magnetic iron oxide particles={(elution rate of aluminum atoms at the time when elution rate of iron atoms is 0%)×(content F (atomic %) measured with X-ray fluorescence spectrometer RIX-2100)}/100

The ratio A/C of the amount of silicon atoms A to the amount of aluminum atoms C is preferably 10/90 or more and 60/40 or less, more preferably 30/70 or more and 50/50 or less.

<5> Amount of Eluted Silicon Atoms B when Silicon Atoms Present in Surface of Magnetic Iron Oxide Particle are Eluted with Sodium Hydroxide Aqueous Solution The amount of silicon atoms B were measured by the following operation.

3 g of the magnetic iron oxide particles were suspended in 300 mL of a 3 mol/L sodium hydroxide aqueous solution, to obtain a suspension of the magnetic iron oxide particles. The suspension was stirred at 50° C. for 30 minutes or more. After that, the suspension was filtered with a 0.1-μm membrane filter, to obtain a filtrate. The obtained filtrate was subjected to quantitative determination for iron atoms and silicon atoms in the filtrate with an inductively-coupled plasma atomic emission spectrophotometer (trade name: ICP-S2000) manufactured by Shimadzu Corporation. The obtained measurement value was defined as H (mg/L), and the amount of eluted silicon atoms B when the silicon atoms present in the surfaces of the magnetic iron oxide particles were eluted with a sodium hydroxide aqueous solution was determined by the following equation.

Amount of eluted silicon atoms B (atomic %) when silicon atoms present in surfaces of magnetic iron oxide particles are eluted with sodium hydroxide aqueous solution={(content *E* (atomic %) measured with *X*-ray fluorescence spectrometer RIX-2100)×*H* (mg/L)}/(concentration of silicon atoms *G* (mg/L) at the time when magnetic iron oxide particles are completely dissolved in the case of elution with hydrochloric acid)

<6> Measurement of Weight-Average Particle Diameter (D4) of Toner

The weight-average particle diameter (D4) of the toner was measured by using a precision particle size distribution-measuring apparatus (trade name: Coulter Counter Multisizer 3) and dedicated software included therewith (trade name: Beckman Coulter Multisizer 3 Version 3.51) manufactured by Beckman Coulter, Inc. The precision particle size distribution-measuring apparatus is equipped with a 100-μm aperture tube, and is a measuring apparatus based on a pore electrical resistance method. The number of effective measurement channels was set to 25,000, and the measurement data was analyzed to calculate the weight-average particle diameter (D4) of the toner.

An electrolyte aqueous solution prepared by dissolving guaranteed sodium chloride in ion-exchanged water so as to have a concentration of 1 mass % may be used in the measurement. An example of such electrolyte aqueous solution is ISOTON II (trade name) manufactured by Beckman Coulter, Inc.

The dedicated software was set as described below prior to the measurement and the analysis.

In the "change standard measurement method (SOM)" screen of the dedicated software, the total count number of a control mode was set to 50,000 particles, the number of times of measurement was set to 1, and a value obtained by using "standard particles each having a particle diameter of 10.0 μm" (manufactured by Beckman Coulter, Inc.) was set as a Kd value. A threshold and a noise level were automatically set by pressing a threshold/noise level measurement button. In addition, a current was set to 1,600 μA, a gain was set to 2, and an electrolyte solution was set to ISOTON II, and a check mark was placed in the flush of the aperture tube.

In the "setting for conversion from pulse to particle diameter screen" of the dedicated software, a bin interval was set to a logarithmic particle diameter, the number of particle diameter bins was set to 256, and a particle diameter range was set to the range of 2 μm to 60 μm.

A specific measurement method is as described below.

(1) 200 mL of the electrolyte aqueous solution was charged into a 250-mL round-bottom beaker made of glass dedicated for Multisizer 3. The beaker was set in a sample stand, and the electrolyte aqueous solution in the beaker was stirred with a stirrer rod at 24 rotations/second in a counterclockwise direction. Then, dirt and bubbles in the aperture tube were removed by the "aperture flush" function of the dedicated software.

(2) 30 mL of the electrolyte aqueous solution was charged into a 100-mL flat-bottom beaker made of glass. 0.3 mL of a diluted solution prepared by diluting Contaminon N (trade name) manufactured by Wako Pure Chemical Industries, Ltd. with ion-exchanged water by three mass fold was added as a dispersant to the electrolyte aqueous solution. Contaminon N is a 10 mass % aqueous solution of a neutral detergent for washing a precision measuring device formed of a nonionic surfactant, an anionic surfactant, and an organic builder and having a pH of 7.

(3) A predetermined amount of ion-exchanged water was charged into the water tank of an ultrasonic dispersing unit (trade name: Ultrasonic Dispersion System Tetora 150) manufactured by Nikkaki Bios Co., Ltd. 2 mL of Contaminon N was added into the water tank. In Ultrasonic Dispersion System Tetora 150, two oscillators each having an oscillatory frequency of 50 kHz are built so as to be out of phase by 180°, and its electric output is 120 W.

(4) The beaker in the section (2) was set in the beaker fixing hole of the ultrasonic dispersing unit, and the ultrasonic dispersing unit was operated. Then, the height position of the beaker was adjusted in order that the liquid level of the electrolyte aqueous solution in the beaker resonated with an ultrasonic wave from the ultrasonic dispersing unit to the fullest extent possible.

(5) 10 mg of toner was gradually added to and dispersed in the electrolyte aqueous solution in the beaker in the section (4) in a state in which the electrolyte aqueous solution was irradiated with the ultrasonic wave. Then, the ultrasonic dispersion treatment was continued for an additional 60 seconds. It should be noted that the temperature of water in the water tank was appropriately adjusted so as to be 10° C. or more and 40° C. or less upon ultrasonic dispersion.

(6) The electrolyte aqueous solution in the section (5) in which the toner had been dispersed was dropped with a pipette to the round-bottom beaker in the section (1) placed in the sample stand, and the concentration of the toner to be measured was adjusted to 5%. Then, measurement was performed until the particle diameters of 50,000 particles were measured.

(7) The measurement data was analyzed with the dedicated software included with the apparatus, and the weight-average particle diameter (D4) of the toner was calculated. It should be noted that an "average diameter" on the "analysis/volume statistics (arithmetic average)" screen of the dedicated software when the dedicated software is set to show a graph in a vol % unit is the weight-average particle diameter (D4).

<7> Softening Point of Binder Resin

The softening point of the resin was measured through use of a constant-pressure extrusion system capillary rheometer (trade name: flow characteristic-evaluating apparatus Flow Tester CFT-500D) manufactured by Shimadzu Corporation in accordance with the manual attached to the apparatus. In this apparatus, a measurement sample filled in a cylinder is increased in temperature to be melted while a predetermined load is applied to the measurement sample with a piston from above, and the melted measurement sample is extruded from a die in a bottom part of the cylinder. At this time, a flow curve representing a relationship between a piston descent amount and the temperature can be obtained.

In the present invention, a "melting temperature in a ½ method" described in the manual attached to the flow characteristic-evaluating apparatus Flow Tester CFT-500D was defined as a softening point. The melting temperature in the ½ method is calculated as described below. First, ½ of a difference between a descent amount $S_{max}$ of the piston at a time when the outflow is finished and a descent amount $S_{min}$ of the piston at a time when the outflow is started is determined (The ½ of the difference is defined as X. $X=(S_{max}-S_{min})/2$). Then, the temperature in the flow curve when the descent amount of the piston reaches the sum of X and $S_{min}$ in the flow curve is the melting temperature Tm in the ½ method.

The measurement sample is obtained by subjecting 1.3 g of the sample to compression molding for 60 seconds under 10 MPa through use of a tablet compressing machine (trade name: NT-100H) manufactured by NPa System Co., Ltd. under an environment of 25° C. to form the resin into a cylindrical shape having a diameter of 8 mm. The measurement conditions of the flow tester CFT-500D are as described below.

Test mode: heating method
Starting temperature: 50° C.
Reached temperature: 200° C.
Measurement interval: 1.0° C.
Rate of temperature increase: 4.0° C./min
Piston sectional area: 1.000 $cm^2$
Test load (piston load): 10.0 kgf (0.9807 MPa)
Preheating time: 300 seconds
Diameter of hole of die: 1.0 mm
Length of die: 1.0 mm <8> Glass Transition Temperature (Tg) of Binder Resin The glass transition temperature (Tg) of the binder resin was measured in an environment of normal temperature and normal humidity (23° C., 50% RH) with a differential scanning calorimeter (DSC) (trade name: MDSC-2920) manufactured by TA Instruments in conformity with ASTM D3418-82. 3 mg of the binder resin was precisely weighted and used as a measurement sample. The measurement sample was loaded into an aluminum pan, and an empty aluminum pan was used as a reference. The measurement temperature range was set to 30° C. or more and 200° C. or less. The temperature was once increased from 30° C. to 200° C. at a rate of temperature increase of 10° C./minute, and then decreased from 200° C. to 30° C. at a rate of temperature decrease of 10° C./minute, and again increased therefrom to 200° C. at a rate of temperature increase of 10° C./minute. In a DSC curve obtained in the second temperature increase process, the intersection between a line intermediate of baselines before and after the appearance of change in specific heat and a differential thermal curve was defined as the glass transition temperature (Tg) of the binder resin.

EXAMPLES

The present invention is hereinafter described in detail by way of Examples.

The magnetic iron oxide particles to be used in the magnetic toner were produced as described below.

Production Example of Magnetic Iron Oxide Particles 1

First Reaction Step

16 L of a ferrous sulfate aqueous solution containing 1.5 mol/L of $Fe^{2+}$, and 15.2 L of a 3.0 mol/L sodium hydroxide solution (corresponding to 0.95 equivalent with respect to $Fe^{2+}$, that is, the ratio 20H/Fe=0.95) were mixed with each other. The pH of the mixture was adjusted to 8.5, to prepare a ferrous salt suspension. The used ferrous sulfate aqueous solution contained 24 moles of $Fe^{2+}$. In addition, at the time of the preparation of the ferrous salt suspension, a solution obtained by diluting 13.3 g of No. 3 water glass (containing 28.8 mass % of $SiO_2$) with 0.5 L of ion-exchanged water was added as a silicon component to the sodium hydroxide solution. The amount of silicon atoms contained in the added No. 3 water glass was 0.25 when the amount of Fe contained in the ferrous salt suspension was defined as 100. That is, the prepared ferrous salt suspension had a ratio (silicon atom/iron atom)×100 of 0.25 (atomic %).

Next, the temperature of the ferrous salt suspension was increased to 90° C., and then subjected to an oxidation reaction by allowing air to pass therethrough at a rate of 70 L per minute, until the oxidation reaction rate of the ferrous salt reached 10%. Thus, the ferrous salt suspension containing magnetite nucleus crystal particles was obtained.

(Second Reaction Step)

Next, to the ferrous salt suspension containing magnetite nucleus crystal particles, 3.2 L of a 3.0 mol/L (3.0 N) sodium hydroxide solution (corresponding to 1.15 equivalents with respect to $Fe^{2+}$, that is, the ratio 20H/Fe=1.15) was added. Next, the temperature of the suspension was increased to 90°

C., and then subjected to the oxidation reaction by allowing air to pass therethrough at a rate of 70 L per minute, until the oxidation reaction rate of the ferrous salt reached 50%.

(Third Reaction Step)

Next, 8.0 mol/L (16.0 N) sulfuric acid in an appropriate amount was added to the ferrous salt suspension containing magnetite nucleus crystal particles, to adjust the pH to 7.5, and the suspension was stirred. It should be noted that the pH condition at this time (pH=7.5) is referred to as intermediate condition. Next, a 3.0 mol/L (3.0 N) sodium hydroxide solution in an appropriate amount was added thereto to adjust the pH to 10.5. At this time, a solution obtained by diluting 21.3 g of No. 3 water glass (containing 28.8 mass % of $SiO_2$) with 0.5 L of ion-exchanged water was added as a silicon component to the ferrous salt suspension containing magnetite nucleus crystal particles (magnetic iron oxide nucleus crystal particles). Herein, the amount of silicon atoms contained in the No. 3 water glass added to the ferrous salt suspension was 0.40 when the amount of Fe contained in the ferrous salt suspension was defined as 100. That is, the prepared ferrous salt suspension had a ratio (silicon atom/iron atom)×100 of 0.40 (atomic %).

Next, the temperature of the ferrous salt suspension was increased to 90° C., and then air was allowed to pass therethrough at a rate of 70 L per minute. Thus, magnetic iron oxide core particles 1 were obtained.

(Surfaces of Magnetic Iron Oxide Particles (Coating Layer (Surface Layer)))

The surfaces of the magnetic iron oxide particles containing silicon atoms and aluminum atoms (hereinafter also referred to as "coating layer" or "surface layer") were formed as described below.

First, No. 3 water glass and an aluminum sulfate solution in appropriate amounts were added to a suspension containing the magnetic iron oxide core particles 1 so that the amount of silicon atoms A and amount of aluminum atoms C in the coating layer (surface layer) became values shown in Tables 1-1 and 1-2. After that, the pH and temperature of the suspension were adjusted to 7.0 and 90° C., respectively, to form the coating layer. Thus, magnetic iron oxide particles 1 were obtained. The No. 3 water glass served as a silicon component, and the aluminum sulfate solution served as an aluminum component.

The obtained magnetic iron oxide particles 1 were washed with water, separated through filtration, dried, and pulverized in conformity with an ordinary method. The obtained magnetic iron oxide particles 1 each had an octahedral shape, and had a number-based median diameter D50 of 0.12 μm. The amount (total amount) of silicon atoms in the magnetic iron oxide particles was 1.2 atomic %, and the amount of silicon atoms A in the surfaces of the magnetic iron oxide particles was 0.57 (atomic %). In addition, the amount (total amount) of aluminum atoms in the magnetic iron oxide particles and the amount of aluminum atoms C in the surfaces of the magnetic iron oxide particles were 0.86 atomic %.

Tables 1-1 and 1-2 show the composition and preparation conditions of the magnetic iron oxide particles 1, and Table 2 shows the physical properties of the magnetic iron oxide particles 1. In each of magnetic iron oxide particles 2 to 15 described below, the amount (total amount) of aluminum atoms in the magnetic iron oxide particles was equal to the amount of aluminum atoms C in the surfaces of the magnetic iron oxide particles.

Production Examples of Magnetic Iron Oxide Particles 2 to 8 and 13 to 15

Magnetic iron oxide core particles 2 to 8 and 13 to 15 were each obtained by the same production method as that in the case of the magnetic iron oxide particles 1 except that the conditions such as the equivalent ratio and amount of silicon atoms in each of the reaction steps were changed as shown in Tables 1-1 and 1-2. In addition, a coating layer (surface layer) containing silicon atoms and aluminum atoms was formed by the same method as in the case of the magnetic iron oxide particles 1 except that the conditions were changed as shown in Tables 1-1 and 1-2. Specifically, No. 3 water glass and an aluminum sulfate solution in appropriate amounts were added to a suspension containing the magnetic iron oxide core particles so that the amount of silicon atoms A and the amount of aluminum atoms C in the coating layer (surface layer) became values shown in Tables 1-1 and 1-2. Then, the pH and temperature of the suspension were adjusted, to form the coating layer. Thus, magnetic iron oxide particles 2 to 8 and 13 to 15 were each obtained.

Tables 1-1 and 1-2 show the compositions and preparation conditions of the magnetic iron oxide particles to 8 and 13 to 15, and Table 2 shows the physical properties of the magnetic iron oxide particles 2 to 8 and 13 to 15.

Production Example of Magnetic Iron Oxide Particles 9

Ferrous sulfate was mixed with water, to prepare 50 L of an iron sulfate aqueous solution containing 2.0 mol/L of $Fe^{2+}$ (containing 100 moles of $Fe^{2+}$). In addition, 10 L of No. 3 water glass containing 0.23 mol/L of $Si^{4+}$ was prepared by using No. 3 water glass. Herein, the amount of silicon atoms contained in the prepared No. 3 water glass was 0.23 when the amount of Fe contained in the iron sulfate aqueous solution was defined as 100. That is, in the prepared iron sulfate aqueous solution and No. 3 water glass, the content of silicon atoms was 0.23 (atomic %) with respect to iron atoms. Next, the water glass was added to the iron sulfate aqueous solution. After that, the mixed aqueous solution and 42 L of a 5.0 mol/L sodium hydroxide aqueous solution (corresponding to 1.05 equivalents with respect to $Fe^{2+}$, that is, 20H/Fe=1.05) were mixed with each other while being stirred, to obtain a ferrous hydroxide slurry. Next, the pH of the ferrous hydroxide slurry was adjusted to 12.0, and the temperature of the ferrous hydroxide slurry was increased to 90° C. Then, the ferrous hydroxide slurry was subjected to an oxidation reaction by blowing air therethrough at a rate of 30 L/min, until 50% of ferrous hydroxide was converted into magnetic iron oxide particles. Next, air was blown therethrough at a rate of 20 L/min until 75% of ferrous hydroxide was converted into magnetic iron oxide particles. Next, air was blown therethrough at a rate of 10 L/min until 90% of ferrous hydroxide was converted into magnetic iron oxide particles. Further, at the time point when the ratio of the magnetic iron oxide particles exceeded 90%, air was blown therethrough at a rate of 5 L/min to complete the oxidation reaction. Thus, a slurry containing magnetic iron oxide core particles each having an octahedral shape was obtained. The slurry was classified with a thickener so as to achieve a number-based particle size distribution shown in Table 2, to remove finer particles and coarser particles. Thus, magnetic iron oxide core particles 9 were obtained.

(Coating Layer (Surface Layer))

The coating layer (surface layer) of silicon atoms and aluminum atoms were formed as described below.

First, No. 3 water glass and an aluminum sulfate solution in appropriate amounts were added to a suspension containing the magnetic iron oxide core particles 9 so that the amount of silicon atoms A and amount of aluminum atoms C in the coating layer (surface layer) became values shown in Tables 1-1 and 1-2. After that, the pH and temperature of the suspension were adjusted, to form the coating layer. Thus, magnetic iron oxide particles 9 were obtained.

Tables 1-1 and 1-2 show the composition and preparation conditions of the magnetic iron oxide particles 9, and Table 2 shows the physical properties of the magnetic iron oxide particles 9.

<Magnetic Iron Oxide Particles 10> (First Reaction Step)

16 L of a ferrous sulfate aqueous solution containing 1.5 mol/L of $Fe^{2+}$, and 14.4 L of a 3.0 mol/L (3.0 N) sodium hydroxide solution (corresponding to 0.90 equivalent with respect to $Fe^{2+}$, that is, the ratio 20H/Fe=0.90) were mixed with each other. The pH of the mixture was adjusted to 9.0, to prepare a ferrous salt suspension. It should be noted that the used ferrous sulfate aqueous solution contained 24 moles of $Fe^{2+}$. In addition, at the time of the preparation of the ferrous salt suspension, No. 3 water glass was added as a silicon component. Herein, the amount of silicon atoms contained in the No. 3 water glass added to the ferrous salt suspension was 0.92 when the amount of Fe contained in the ferrous salt suspension was defined as 100. That is, in the prepared ferrous salt suspension, the content of silicon atoms was 0.92 (atomic %) with respect to iron atoms. Next, the temperature of the ferrous salt suspension was increased to 90° C., and then subjected to an oxidation reaction by allowing air to pass therethrough at a rate of 70 L per minute, until the oxidation reaction rate of the ferrous salt reached 30%. Thus, the ferrous salt suspension containing magnetic iron oxide core particles was obtained.

(Second Reaction Step)

To the ferrous salt suspension containing magnetic iron oxide core particles, 3.2 L of a 3.0 mol/L (3.0 N) sodium hydroxide solution (corresponding to 1.10 equivalents with respect to 24 moles of $Fe^{2+}$ as the total amount with the sodium hydroxide solution added in the first reaction step, that is, the ratio 20H/Fe=1.10) was added. Next, the temperature of the mixture was increased to 90° C., and then air was allowed to pass therethrough at a rate of 70 L per minute to complete the oxidation reaction. Thus, a slurry containing the magnetic iron oxide core particles was obtained. The slurry was classified with a thickener so as to achieve a number-based particle size distribution shown in Table 2, to remove finer particles and coarser particles. Thus, magnetic iron oxide core particles 10 were obtained.

(Coating Layer (Surface Layer))

The coating layer (surface layer) of silicon atoms and aluminum atoms were formed as described below.

First, No. 3 water glass and an aluminum sulfate solution in appropriate amounts were added to a suspension containing the magnetic iron oxide core particles 10 so that the amount of silicon atoms A and amount of aluminum atoms C in the coating layer (surface layer) became values shown in Tables 1-1 and 1-2. After that, the pH and temperature of the suspension were adjusted, to form the coating layer. Thus, magnetic iron oxide particles 10 were obtained.

Tables 1-1 and 1-2 show the composition and preparation conditions of the magnetic iron oxide particles 10, and Table 2 shows the physical properties of the magnetic iron oxide particles 10.

Production Example of Magnetic Iron Oxide Particles 11

The conditions such as the equivalent ratio and amount of silicon atoms in each of the reaction steps were changed as shown in Tables 1-1 and 1-2, and a ferrous salt suspension was obtained by the same method as that in the case of the magnetic iron oxide particles 1 until after the completion of the third reaction step. The ferrous salt suspension was classified with a thickener so as to achieve a number-based particle size distribution shown in Table 2, to remove finer particles and coarser particles. Thus, magnetic iron oxide core particles 11 were obtained.

(Coating Layer (Surface Layer))

The coating layer (surface layer) of silicon atoms and aluminum atoms were formed as described below.

First, No. 3 water glass and an aluminum sulfate solution in appropriate amounts were added to a suspension containing the magnetic iron oxide core particles 11 so that the amount of silicon atoms A and amount of aluminum atoms C in the coating layer (surface layer) became values shown in Tables 1-1 and 1-2. After that, the pH and temperature of the suspension were adjusted, to form the coating layer. Thus, magnetic iron oxide particles 11 were obtained.

Tables 1-1 and 1-2 show the composition and preparation conditions of the magnetic iron oxide particles 11, and Table 2 shows the physical properties of the magnetic iron oxide particles 11.

Production Example of Magnetic Iron Oxide Particles 12

Ferrous sulfate was mixed with water, to prepare 50 L of an iron sulfate aqueous solution containing 2.0 mol/L of $Fe^{2+}$ (containing 100 moles of $Fe^{2+}$). In addition, 10 L of No. 3 water glass containing 0.23 mol/L of $Si^{4+}$ was prepared by using No. 3 water glass. Herein, the amount of silicon atoms contained in the prepared No. 3 water glass was 0.23 when the amount of Fe contained in the iron sulfate aqueous solution was defined as 100. That is, in the prepared iron sulfate aqueous solution and No. 3 water glass, the content of silicon atoms was 0.23 (atomic %) with respect to iron atoms. Next, the water glass was added to the iron sulfate aqueous solution. After that, the mixed aqueous solution and 42 L of a 5.0 mol/L sodium hydroxide aqueous solution (corresponding to 1.05 equivalents with respect to $Fe^{2+}$, that is, 20H/Fe=1.05) were mixed with each other while being stirred, to obtain a ferrous hydroxide slurry. Next, the pH of the ferrous hydroxide slurry was adjusted to 12.0, and the temperature of the ferrous hydroxide slurry was increased to 90° C. Then, the ferrous hydroxide slurry was subjected to an oxidation reaction by blowing air therethrough at a rate of 30 L/min, until 50% of ferrous hydroxide was converted into magnetic iron oxide particles. Next, air was blown therethrough at a rate of 20 L/min until 75% of ferrous hydroxide was converted into magnetic iron oxide particles. Next, air was blown therethrough at a rate of 10 L/min until 90% of ferrous hydroxide was converted into magnetic iron oxide particles. Further, at the time point when the ratio of the magnetic iron oxide particles exceeded 90%, air was blown therethrough at a rate of 5 L/min to complete the oxidation reaction. Thus, a slurry containing magnetic iron oxide core particles 12 each having an octahedral shape was obtained.

(Coating Layer (Surface Layer))

The coating layer (surface layer) of silicon atoms and aluminum atoms were formed as described below.

First, No. 3 water glass and an aluminum sulfate solution in appropriate amounts were added to a slurry containing the magnetic iron oxide core particles 12 so that the amount of silicon atoms A and amount of aluminum atoms C in the coating layer (surface layer) became values shown in Tables 1-1 and 1-2. After that, the pH and temperature of the suspension were adjusted, to form the coating layer. Thus, magnetic iron oxide particles 12 were obtained.

Tables 1-1 and 1-2 show the composition and preparation conditions of the magnetic iron oxide particles 12, and Table 2 shows the physical properties of the magnetic iron oxide particles 12.

TABLE 1-1

| | First reaction step | | | | | | | | Second reaction step | | |
|---|---|---|---|---|---|---|---|---|---|---|---|
| | Ferrous salt solution | Alkali hydroxide aqueous solution | Equivalent ratio (2OH/Fe) | Water-soluble silicate salt | Content of silicon atoms with respect to iron atoms (atomic %) | pH | Oxidation reaction rate (%) | Reaction temperature (° C.) | Equivalent ratio (2OH/Fe) | Oxidation reaction rate (%) | Reaction temperature (° C.) |
| Magnetic iron oxide particles 1 | Ferrous sulfate aqueous solution | Sodium hydroxide aqueous solution | 0.95 | No. 3 water glass | 0.25 | 8.5 | 10 | 90 | 1.15 | 50 | 90 |
| Magnetic iron oxide particles 2 | Ferrous sulfate aqueous solution | Sodium hydroxide aqueous solution | 0.94 | No. 3 water glass | 0.24 | 8.3 | 10 | 90 | 1.05 | 51 | 90 |
| Magnetic iron oxide particles 3 | Ferrous sulfate aqueous solution | Sodium hydroxide aqueous solution | 0.94 | No. 3 water glass | 0.23 | 8.4 | 10 | 90 | 1.10 | 55 | 90 |
| Magnetic iron oxide particles 4 | Ferrous sulfate aqueous solution | Sodium hydroxide aqueous solution | 0.98 | No. 3 water glass | 0.24 | 8.0 | 10 | 90 | 1.15 | 52 | 90 |
| Magnetic iron oxide particles 5 | Ferrous sulfate aqueous solution | Sodium hydroxide aqueous solution | 0.99 | No. 3 water glass | 0.21 | 8.7 | 10 | 90 | 1.15 | 60 | 90 |
| Magnetic iron oxide particles 6 | Ferrous sulfate aqueous solution | Sodium hydroxide aqueous solution | 0.95 | No. 3 water glass | 0.90 | 8.9 | 9 | 90 | 1.20 | 50 | 90 |
| Magnetic iron oxide particles 7 | Ferrous sulfate aqueous solution | Sodium hydroxide aqueous solution | 0.99 | No. 3 water glass | 0.24 | 8.7 | 10 | 90 | 1.15 | 60 | 90 |
| Magnetic iron oxide particles 8 | Ferrous sulfate aqueous solution | Sodium hydroxide aqueous solution | 0.99 | No. 3 water glass | 0.24 | 8.7 | 10 | 90 | 1.15 | 60 | 90 |
| Magnetic iron oxide particles 9 | Ferrous sulfate aqueous solution | Sodium hydroxide aqueous solution | 1.05 | No. 3 water glass | 0.23 | 12.0 | 100 | 90 | — | — | — |
| Magnetic iron oxide particles 10 | Ferrous sulfate aqueous solution | Sodium hydroxide aqueous solution | 0.90 | No. 3 water glass | 0.92 | 9.0 | 30 | 90 | 1.10 | 100 | 90 |
| Magnetic iron oxide particles 11 | Ferrous sulfate aqueous solution | Sodium hydroxide aqueous solution | 1.04 | — | — | 6.0 to 8.0 | 30 | 80 | 1.05 | 60 | 80 |
| Magnetic iron oxide particles 12 | Ferrous sulfate aqueous solution | Sodium hydroxide aqueous solution | 1.05 | No. 3 water glass | 0.23 | 12.0 | 100 | 90 | — | — | — |
| Magnetic iron oxide particles 13 | Ferrous sulfate aqueous solution | Sodium hydroxide aqueous solution | 0.98 | No. 3 water glass | 0.95 | 9.0 | 10 | 90 | 1.20 | 50 | 90 |
| Magnetic iron oxide particles 14 | Ferrous sulfate aqueous solution | Sodium hydroxide aqueous solution | 0.95 | No. 3 water glass | 0.57 | 8.6 | 12 | 90 | 1.15 | 55 | 90 |
| Magnetic iron oxide particles 15 | Ferrous sulfate aqueous solution | Sodium hydroxide aqueous solution | 1.04 | — | — | 6.0 to 8.0 | 30 | 80 | 1.05 | 60 | 80 |

TABLE 1-2

| | | Third reaction step | | | | | Coating layer (surface layer) | |
|---|---|---|---|---|---|---|---|---|
| | Intermediate condition pH | Alkali hydroxide aqueous solution | pH | Water-soluble silicate salt | Content of silicon atoms with respect to iron atoms (atomic %) | Reaction temperature (° C.) | Amount of silicon atoms A (atomic %) | Amount of aluminum atoms C (atomic %) |
| Magnetic iron oxide particles 1 | 7.5 | Sodium hydroxide aqueous solution | 10.5 | No. 3 water glass | 0.40 | 90 | 0.57 | 0.86 |
| Magnetic iron oxide particles 2 | 7.6 | Sodium hydroxide aqueous solution | 10.0 | No. 3 water glass | 0.40 | 90 | 0.57 | 0.86 |
| Magnetic iron oxide particles 3 | 8.0 | Sodium hydroxide aqueous solution | 10.5 | No. 3 water glass | 0.40 | 90 | 0.57 | 0.86 |
| Magnetic iron oxide particles 4 | 7.2 | Sodium hydroxide aqueous solution | 10.0 | No. 3 water glass | 0.39 | 90 | 0.76 | 0.86 |
| Magnetic iron oxide particles 5 | 8.5 | Sodium hydroxide aqueous solution | 10.5 | No. 3 water glass | 0.21 | 90 | 0.97 | 0.86 |
| Magnetic iron oxide particles 6 | 8.3 | Sodium hydroxide aqueous solution | 10.3 | No. 3 water glass | 0.39 | 90 | 0.10 | 0.86 |
| Magnetic iron oxide particles 7 | 8.5 | Sodium hydroxide aqueous solution | 10.5 | No. 3 water glass | 0.24 | 90 | 0.64 | 0.43 |
| Magnetic iron oxide particles 8 | 8.5 | Sodium hydroxide aqueous solution | 10.5 | No. 3 water glass | 0.24 | 90 | 0.67 | 0.43 |
| Magnetic iron oxide particles 9 | — | — | — | — | — | — | 0.47 | 0.20 |
| Magnetic iron oxide particles 10 | — | — | — | — | — | — | 0.10 | 1.10 |
| Magnetic iron oxide particles 11 | 6.0 to 8.0 | Sodium hydroxide aqueous solution | 6.0 to 8.0 | No. 3 water glass | 0.44 | 80 | 0.72 | 0.08 |
| Magnetic iron oxide particles 12 | — | — | — | — | — | — | 0.72 | 0.08 |
| Magnetic iron oxide particles 13 | 8.6 | Sodium hydroxide aqueous solution | 10.3 | No. 3 water glass | 0.39 | 90 | 0.45 | 0.05 |
| Magnetic iron oxide particles 14 | 8.0 | Sodium hydroxide aqueous solution | 10.5 | No. 3 water glass | 0.39 | 90 | 0.45 | 0.05 |
| Magnetic iron oxide particles 15 | 6.0 to 8.0 | Sodium hydroxide aqueous solution | 6.0 to 8.0 | No. 3 water glass | 0.44 | 80 | 0.45 | 0.05 |

TABLE 2

| | D50 (μm) | D10/D50 | D90/D50 | Shape of particles | Amount (total amount) of silicon atoms in magnetic iron oxide particles | Amount of silicon atoms A (atomic %) | B/A × 100 (atomic %) | Amount of aluminum atoms C (atomic %) |
|---|---|---|---|---|---|---|---|---|
| Magnetic iron oxide particles | 0.12 | 0.60 | 1.40 | Octahedral shape | 1.2 | 0.57 | 30 | 0.86 |

TABLE 2-continued

| | D50 (μm) | D10/D50 | D90/D50 | Shape of particles | Amount (total amount) of silicon atoms in magnetic iron oxide particles | Amount of silicon atoms A (atomic %) | B/A × 100 (atomic %) | Amount of aluminum atoms C (atomic %) |
|---|---|---|---|---|---|---|---|---|
| Magnetic iron oxide particles | 0.10 | 0.55 | 1.45 | Octahedral shape | 1.2 | 0.57 | 35 | 0.86 |
| Magnetic iron oxide particles | 0.14 | 0.54 | 1.46 | Octahedral shape | 1.2 | 0.57 | 35 | 0.86 |
| Magnetic iron oxide particles | 0.15 | 0.50 | 1.47 | Octahedral shape | 1.4 | 0.76 | 42 | 0.86 |
| Magnetic iron oxide particles | 0.15 | 0.49 | 1.48 | Octahedral shape | 1.4 | 0.97 | 45 | 0.86 |
| Magnetic iron oxide particles | 0.05 | 0.49 | 1.48 | Octahedral shape | 1.4 | 0.10 | 50 | 0.86 |
| Magnetic iron oxide particles | 0.15 | 0.45 | 1.50 | Octahedral shape | 1.1 | 0.64 | 50 | 0.43 |
| Magnetic iron oxide particles | 0.15 | 0.45 | 1.50 | Octahedral shape | 1.2 | 0.67 | 75 | 0.43 |
| Magnetic iron oxide particles | 0.15 | 0.44 | 1.50 | Octahedral shape | 0.70 | 0.47 | 90 | 0.20 |
| Magnetic iron oxide particles | 0.15 | 0.40 | 1.50 | Polyhedral shape | 1.0 | 0.10 | 95 | 1.10 |
| Magnetic iron oxide particles | 0.15 | 0.40 | 1.50 | Spherical shape | 1.2 | 0.72 | 95 | 0.08 |
| Magnetic iron oxide particles | 0.15 | 0.39 | 1.51 | Octahedral shape | 0.95 | 0.72 | 90 | 0.08 |
| Magnetic iron oxide particles | 0.04 | 0.30 | 1.55 | Octahedral shape | 1.8 | 0.45 | 95 | 0.05 |
| Magnetic iron oxide particles | 0.16 | 0.35 | 1.58 | Octahedral shape | 1.4 | 0.45 | 95 | 0.05 |
| Magnetic iron oxide particles | 0.17 | 0.30 | 1.60 | Spherical shape | 0.89 | 0.45 | 95 | 0.05 |

The binder resin to be used for the magnetic toner was produced as described below.

Production Example of Binder Resin H1

Bisphenol A ethylene oxide (2.2 mole adduct): 80.0 parts by mole
Ethylene glycol: 20.0 parts by mole
Terephthalic acid: 70.0 parts by mole
Trimellitic anhydride: 30.0 parts by mole First, a mixture of the above-mentioned monomers in an amount of 95 mass % with respect to the total amount of monomers for forming the polyester unit, and an aliphatic monoalcohol having 36 carbon atoms (secondary monoalcohol having 36 carbon atoms that was paraffin wax having a hydroxy group) in an amount of 5.0 mass % with respect to the total amount of the monomers for forming the polyester unit were loaded in a 5-L autoclave together with 0.2 part by mass of titanium tetrabutoxide. A reflux condenser, a moisture separator, a nitrogen gas introducing pipe, a thermometer, and a stirrer were mounted to the autoclave, and a condensation polymerization reaction was conducted at 230° C. while a nitrogen gas was introduced into the autoclave. It should be noted that, at the time of the reaction, the reaction time period was controlled so that a predetermined softening point was achieved. After the completion of the reaction, a resin was taken out from the container, followed by cooling and pulverization. Thus, a binder resin H1 was obtained.

Production Example of Binder Resin H2

Bisphenol A ethylene oxide (2.2 mole adduct): 100.0 parts by mole
Terephthalic acid: 70.0 parts by mole
Trimellitic anhydride: 30.0 parts by mole First, a mixture of the above-mentioned monomers in an amount of 99 mass % with respect to the total amount of monomers for forming the polyester unit, and an aliphatic monoalcohol having 34 carbon atoms (secondary monoalcohol having 34 carbon atoms that was paraffin wax having a hydroxy group) in an amount of 1 mass % with respect to the total amount of the monomers for forming the polyester unit were loaded in a 5-L autoclave together with 0.2 part by mass of titanium tetrabutoxide. A reflux condenser, a moisture separator, a nitrogen gas introducing pipe, a thermometer, and a stirrer were mounted to the autoclave, and a condensation polymerization reaction was conducted at 230° C. while a nitrogen gas was introduced into the autoclave. It should be noted that, at the time of the reaction, the reaction time period was controlled so that a predetermined softening point was achieved. After the completion of the reaction, a resin was taken out from the container, followed by cooling and pulverization. Thus, a binder resin H2 was obtained.

Production Examples of Binder Resins H3 to H5

Binder resins H3 to H5 were each obtained in the same manner as in the production example of the binder resin H2 except that the aliphatic compound, the catalyst in the polymerization, the predetermined softening point, a predetermined glass transition temperature, the amount of the aliphatic compound (mass %) with respect to the total amount of monomers for forming the polyester unit were changed as shown in Table 3. In addition, as an aliphatic monocarboxylic acid in the "aliphatic compound" column shown in Table 3, a wax that was polyethylene having a carboxy group at its one end was used.

Production Example of Binder Resin H6

Bisphenol A ethylene oxide (2.2 mole adduct): 100.0 parts by mole
Terephthalic acid: 70.0 parts by mole
Trimellitic anhydride: 30.0 parts by mole First, 100 parts by mass of a mixture of the above-mentioned monomers was loaded in a 5-L autoclave together with 0.2 part by mass of titanium tetrabutoxide. A reflux condenser, a moisture separator, a nitrogen gas introducing pipe, a thermometer, and a stirrer were mounted to the autoclave, and a condensation polymerization reaction was conducted at 230° C. while a nitrogen gas was introduced into the autoclave. It should be noted that, at the time of the reaction, the reaction time period was controlled so that a predetermined softening point was achieved. After the completion of the reaction, a resin was taken out from the container, followed by cooling and pulverization. Thus, a binder resin H8 was obtained.

Production Example of Binder Resin H7

A binder resin H7 was obtained in the same manner as in the production example of the binder resin H6 except that the catalyst in the polymerization, the predetermined softening point, a predetermined glass transition temperature were changed as shown in Table 3.

Production Example of Binder Resin L1

Bisphenol A ethylene oxide (2.2 mole adduct): 40.0 parts by mole
Bisphenol A propylene oxide (2.2 mole adduct): 40.0 parts by mole
Ethylene glycol: 20.0 parts by mole
Terephthalic acid: 100.0 parts by mole First, a mixture of the above-mentioned monomers in an amount of 95 mass % with respect to the total amount of monomers for forming the polyester unit, and an aliphatic monoalcohol having 50 carbon atoms (primary monoalcohol wax having 50 carbon atoms that was polyethylene having a hydroxy group at its one end) in an amount of 5 mass % with respect to the total amount of the monomers for forming the polyester unit were loaded in a 5-L autoclave together with 0.2 part by mass of titanium tetrabutoxide. A reflux condenser, a moisture separator, a nitrogen gas introducing pipe, a thermometer, and a stirrer were mounted to the autoclave, and a condensation polymerization reaction was conducted at 230° C. while a nitrogen gas was introduced into the autoclave. It should be noted that, at the time of the reaction, the reaction time period was controlled so that a predetermined softening point was achieved. After the completion of the reaction, a resin was taken out from the container, followed by cooling and pulverization. Thus, a binder resin L1 was obtained.

Production Example of Binder Resin L2

A binder resin L2 was obtained in the same manner as in the production example of the binder resin L1 except that the aliphatic compound, the catalyst in the polymerization, the predetermined softening point, a predetermined glass transition temperature, the amount of the aliphatic compound (mass %) with respect to the total amount of monomers for forming the polyester unit were changed as shown in Table 3.

Production Example of Binder Resin L3

Bisphenol A ethylene oxide (2.2 mole adduct): 50.0 parts by mole
Bisphenol A propylene oxide (2.2 mole adduct): 50.0 parts by mole
Terephthalic acid: 100.0 parts by mole First, a mixture of the above-mentioned monomers in an amount of 94 mass % with respect to the total amount of monomers for forming the polyester unit, and an aliphatic monoalcohol having 80 carbon atoms (primary monoalcohol wax having 80 carbon atoms that was polyethylene having a hydroxy group at its one end) in an amount of 6 mass % with respect to the total amount of the monomers for forming the polyester unit were loaded in a 5-L autoclave together with 0.2 part by mass of titanium tetrabutoxide. A reflux condenser, a moisture separator, a nitrogen gas introducing pipe, a thermometer, and a stirrer were mounted to the autoclave, and a condensation polymerization reaction was conducted at 230° C. while a nitrogen gas was introduced into the autoclave. It should be noted that, at the time of the reaction, the reaction time period was controlled so that a predetermined softening point was achieved. After the completion of the reaction, a resin was taken out from the container, followed by cooling and pulverization. Thus, a binder resin L3 was obtained.

Production Examples of Binder Resins L4 to L9

Binder resins L4 to L9 were each obtained in the same manner as in the production example of the binder resin L3 except that the aliphatic compound, the catalyst in the polymerization, the predetermined softening point, a predetermined glass transition temperature, the amount of the aliphatic compound (mass %) with respect to the total amount of monomers for forming the polyester unit were changed as shown in Table 3. In addition, as an aliphatic monocarboxylic acid in the "aliphatic compound" column shown in Table 3, a wax that was polyethylene having a carboxy group at its one end was used.

Production Example of Binder Resin L10

Bisphenol A ethylene oxide (2.2 mole adduct): 50.0 parts by mole
Bisphenol A propylene oxide (2.2 mole adduct): 50.0 parts by mole
Terephthalic acid: 100.0 parts by mole First, 100 parts by mass of a mixture of the above-mentioned monomers was loaded in a 5-L autoclave together with 0.2 part by mass of dibutyl tin oxide. A reflux condenser, a moisture separator, a nitrogen gas introducing pipe, a thermometer, and a stirrer were mounted to the autoclave, and a condensation polymerization reaction was conducted at 230° C. while a nitrogen gas was introduced into the autoclave. It should be noted that, at the time of the reaction, the reaction time period was controlled so that a predetermined softening point was achieved. After the completion of the reaction, a resin was taken out from the container, followed by cooling and pulverization. Thus, a binder resin L10 was obtained.

TABLE 3

| | Softening point (° C.) | Glass transition temperature (° C.) | Kind of resin | Catalyst in condensation polymerization reaction | Aliphatic compound | Carbon number of aliphatic compound | Amount of aliphatic compound (with respect to total amount of monomers) (mass %) |
|---|---|---|---|---|---|---|---|
| Binder resin H1 | 125 | 54 | Polyester | Titanium tetrabutoxide | Aliphatic monoalcohol | 36 | 5.0 |
| Binder resin H2 | 130 | 55 | Polyester | Titanium tetrabutoxide | Aliphatic monoalcohol | 34 | 1.0 |
| Binder resin H3 | 135 | 55 | Polyester | Titanium tetrabutoxide | Aliphatic monoalcohol | 32 | 6.0 |
| Binder resin H4 | 135 | 60 | Polyester | Titanium tetrabutoxide | Aliphatic monoalcohol | 80 | 6.0 |
| Binder resin H5 | 140 | 61 | Polyester | Titanium tetrabutoxide | Aliphatic monocarboxylic acid | 80 | 6.0 |
| Binder resin H6 | 140 | 61 | Polyester | Titanium tetrabutoxide | — | — | — |
| Binder resin H7 | 140 | 61 | Polyester | Dibutyl tin oxide | — | — | — |
| Binder r esin L1 | 85 | 50 | Polyester | Titanium tetrabutoxide | Aliphatic monoalcohol | 50 | 5.0 |
| Binder resin L2 | 85 | 50 | Polyester | Titanium tetrabutoxide | Aliphatic monoalcohol | 60 | 1.0 |
| Binder r esin L3 | 90 | 51 | Polyester | Titanium tetrabutoxide | Aliphatic monoalcohol | 80 | 6.0 |
| Binder resin L4 | 95 | 53 | Polyester | Titanium tetrabutoxide | Aliphatic monocarboxylic acid | 80 | 6.0 |
| Binder resin L5 | 95 | 53 | Polyester | Dibutyl tin oxide | Aliphatic monocarboxylic acid | 80 | 10 |
| Binder resin L6 | 100 | 55 | Polyester | Dibutyl tin oxide | Aliphatic monocarboxylic acid | 30 | 0.10 |
| Binder resin L7 | 100 | 56 | Polyester | Dibutyl tin oxide | Aliphatic monocarboxylic acid | 102 | 11 |
| Binder resin L8 | 100 | 56 | Polyester | Dibutyl tin oxide | Aliphatic monocarboxylic acid | 28 | 11 |
| Binder resin L9 | 100 | 56 | Polyester | Dibutyl tin oxide | Aliphatic monocarboxylic acid | 104 | 11 |
| Binder resin L10 | 105 | 56 | Polyester | Dibutyl tin oxide | — | — | — |

A charge control resin to be used in the magnetic toner was produced as described below.

Production Example of Charge Control Resin

As solvents, 200 parts by mass of methanol, 150 parts by mass of 2-butanone, and 50 parts by mass of 2-propanol were added to a pressurizable reaction vessel mounted with a reflux tube, a stirrer, a thermometer, a nitrogen introducing pipe, a dropping device, and a decompressor. Then, as monomers, 78 parts by mass of styrene, 15 parts by mass of n-butyl acrylate, and 7 parts by mass of 2-acrylamide-2-methylpropane sulfonic acid were added thereto, and the mixture was heated to 70° C. while being stirred. A solution obtained by diluting 1 part by mass of 2,2'-azobis(2-methylbutyronitrile) as a polymerization initiator with 20 parts by mass of 2-butanone was dropped over 1 hour and the mixture was continued to be stirred for 5 hours. Further, the solution obtained by diluting 1 part by mass of 2,2'-azobis (2-methylbutyronitrile) with 20 parts by mass of 2-butanone was dropped over 30 minutes, and the mixture was further stirred for 5 hours to complete the polymerization. The polymerization solvents were distilled away under reduced pressure, and then an obtained polymer was coarsely pulverized so as to achieve a size of 100 μm or less with a cutter mill equipped with a 150-mesh screen. The obtained sulfur-containing copolymer was found to have a glass transition temperature (Tg) of 74° C., a weight-average molecular weight (Mw) of 27,000, and an acid value of 23 mgKOH/g. The copolymer is referred to as sulfur-containing copolymer (S−1).

Example 1

Production Example of Toner No. 1

Materials used for the production of a toner No. 1 are shown below. It should be noted that the combination of a used binder resin and used magnetic iron oxide particles is shown in Table 4.

Binder resin H1: 70 parts by mass
Binder resin L1: 30 parts by mass
Fischer-Tropsch wax (manufactured by Sasol Wax, C105, melting point: 105° C.): 2 parts by mass Magnetic iron oxide particles 1: 60 parts by mass Sulfur-containing copolymer (S−1): 2 parts by mass First, the above-mentioned materials were pre-mixed with a Henschel mixer, and then melt-kneaded with a twin screw kneading extruder. As this time, a retention time period was adjusted so that the kneaded resin had a temperature of 150° C. The obtained kneaded product was cooled, coarsely pulverized with a hammer mill, and then pulverized with a turbo mill. The obtained fine particles were classified with a multi-division classifier utilizing a Coanda effect (trade name: Elbow Jet Classifier, manufactured by Nittetsu Mining Co., Ltd.). Thus, a toner particles having a weight-average particle diameter (D4) of 7.3 μm was obtained. 1.0 Part by mass of hydrophobic silica fine particles (BET specific surface area: 140 $m^2/g$, subjected to hexamethyldisilazane treatment as hydrophobic treatment) and 3.0 parts by mass of strontium titanate (volume-average particle diameter: 1.6 μm) were externally added and mixed into 100 parts by mass of the toner particles. Next, the mixture was sieved with a mesh having an aperture of 150 μm. Thus, a toner No. 1 was obtained.

The following evaluations were performed on the toner No. 1. The evaluation results are shown in Table 5.

<Evaluation of Coarseness>

The magnetic toner was left in an environment in which coarseness due to the transfer penetration was considered to be liable to occur for a long time period (45° C., 95% RH, for 1 month). After that, the magnetic toner was subjected to an endurance test on 100,000 sheets using A4-size test pattern having a printing ratio of 1% in a high-temperature and high-humidity (30° C., 80% RH) environment with a remodeled machine obtained by remodeling a digital copying machine (trade name: image RUNNER 4051) manufactured by Canon Inc. so that the machine had a process speed of 252 mm/second. After that, a half-tone (30 h) image was formed, and the image was evaluated for its coarseness based on the following criteria. Office planner A4 paper (basis weight: 68 $g/m^2$) was used as paper. It should be noted that the 30 h image is a notation in which 256 gradation levels are represented by a hexadecimal number system (0 to 255 in the decimal number system correspond to 00 to FF in the hexadecimal number system). The "h" in 30 h is the initial character of hexadecimal (hexadecimal number system), and indicates the notation by the hexadecimal number system. It should be noted that the "00 h image" means a white portion (solid white image, the first gradation level in the 256 gradation levels), and the "FFh image" means a solid portion (solid black image, the 256th gradation level in the 256 gradation levels). The 30 h image is one kind of half-tone images.

The image was measured for the areas of 1,000 dots with a digital microscope VHX-500 (trade name: lens wide-range zoom lens VH-Z100) manufactured by Keyence Corporation. A dot area number average (S) and a dot area standard deviation (σ) were calculated, and a dot reproducibility index was calculated by the following equation. Then, the coarseness of the half-tone image was evaluated using the dot reproducibility index (I).

Dot reproducibility index (I)=G/S×100

The coarseness was evaluated based on the following evaluation criteria.

A: I of less than 2.0

B: I of 2.0 or more and less than 4.0

C: I of 4.0 or more and less than 6.0

D: I of 6.0 or more and less than 8.0

E: I of 8.0 or more

<Evaluation of Scattering>

The evaluation of the scattering was scattering evaluation for a fine thin line in association with the image quality of a graphical image. In the evaluation, a one-dot line image, in which scattering was liable to occur, was output, and the reproducibility of the line and scattering of the toner around the line were visually observed. In the evaluation, the image was output with a remodeled machine obtained by remodeling a digital copying machine (trade name: image RUNNER 4051) manufactured by Canon Inc. so that the machine had a process speed of 252 mm/second. The evaluation was performed using A4-size test pattern having a printing ratio of 1% in a low-temperature and low-humidity (L/L) environment (15° C., 10% RH) after an endurance test on 100,000 sheets, based on the following criteria.

(Evaluation Criteria)

A: No scattering occurs, and line reproducibility is satisfactory.

B: Scattering hardly occurs, and line reproducibility is satisfactory.

C: Slight scattering is observed.

D: Scattering is observed, but has a small influence on line reproducibility.

E: Scattering is observed, and line reproducibility is lower than that of the criterion D.

<Evaluation of Tailing>

The tailing was determined as follows: a line image in which the line width was specified in the electrostatic latent image was output as a vertical line and a horizontal line in a low-temperature and low-humidity (L/L) environment (15° C., 10% RH), in which tailing was liable to occur; and the tailing was determined as the line width ratio of the vertical line to the horizontal line (ratio of vertical line/horizontal line). The tailing occurs along the rotation direction of an electrophotographic photosensitive member as the electrostatic latent image bearing member. Therefore, the width of the horizontal line is more liable to be affected by the tailing than the vertical line, to be widened. In consequence, the ratio of vertical line/horizontal line is generally 1 or less. It is considered that the tailing is more suppressed when the ratio is closer to 1. The details of the evaluation are hereinafter described.

The magnetic toner was left in an environment in which tailing due to an aggregate was considered to be liable to occur for a long time period (45° C., 95% RH, 1 month). After that, images were output in a low-temperature and low-humidity environment (15° C., 10% RH) with a remodeled machine obtained by remodeling a digital copying machine (trade name: image RUNNER 4051) manufactured by Canon Inc. so that the machine had a process speed of 252 mm/second. The images to be used in the evaluation of the tailing were line images obtained by forming latent images of 600 dpi having 10-dot vertical and horizontal patterns (electrostatic latent images each having a line width of 420 μm) on the surface of the electrophotographic photosensitive member at 1-cm intervals through laser exposure, developing the images, and transferring and fixing the images onto an OHP sheet made of PET. For the obtained vertical and horizontal line pattern images, toner laid-on levels in the vertical and horizontal lines were each determined as a surface roughness profile with a surface roughness meter (trade name: SURF CORDER SE-30H) manufactured by Kosaka Laboratory Ltd. Then, the line widths were each determined from the width in the profile, and the ratio of vertical line/horizontal line was calculated. The calculated value was evaluated based on the following criteria.

(Evaluation Criteria)

A: Ratio of vertical line/horizontal line of 0.95 or more and 1.00 or less

B: Ratio of vertical line/horizontal line of 0.90 or more and less than 0.95

C: Ratio of vertical line/horizontal line of 0.80 or more and less than 0.90

D: Ratio of vertical line/horizontal line of 0.70 or more and less than 0.80

E: Ratio of vertical line/horizontal line of less than 0.70

<Evaluation of Durability Stability>

The durability stability was evaluated through an endurance test in a high-temperature and high-humidity (30° C., 80% RH) environment with a remodeled machine obtained by remodeling a digital copying machine (trade name: image RUNNER 4051) manufactured by Canon Inc. so that the machine had a process speed of 252 mm/second. A developing bias was set so that an initial reflection density was 1.4, and a solid white image (printing ratio: 0%) was output on 10,000 sheets. After the output on 10,000 sheets, an image in which a 20-mm square solid black patch was arranged on 5 points in a development area was output. Then, the durability was evaluated through comparison of a difference in image density between a five-point average density after the endurance test and the initial image density.

It should be noted that the image density was measured as a relative density with respect to an image of a white portion having a manuscript density of 0.00 with Macbeth Reflection Densitometer RD918 (trade name) manufactured by Macbeth.

A: Density difference of less than 0.10

B: Density difference of 0.10 or more and less than 0.20

C: Density difference of 0.20 or more and less than 0.30

D: Density difference of 0.30 or more and less than 0.40

E: Density difference of 0.40 or more

<Evaluation of Fogging>

The fogging was evaluated as follows: an image was output on 10,000 sheets using A4-size test pattern having a printing ratio of 1% in a low-temperature and low-humidity (15° C., 10% RH) environment with a remodeled machine obtained by remodeling a digital copying machine (trade name: image RUNNER 4051) manufactured by Canon Inc. so that the machine had a process speed of 252 mm/second; and two solid white images were output and then the second solid white image was evaluated based on the following criteria. It should be noted that the measurement was performed with a reflectometer manufactured by Tokyo Denshoku CO., LTD. (trade name: REFLECTOMETER MODEL TC-6DS). The fogging was evaluated by defining Dr-Ds as a fogging value, when Ds represented the worst value of the reflection density of the white portion after the image formation, and Dr represented the average reflection density of a transfer material before the image formation. Accordingly, a smaller value indicates that the fogging is more suppressed.

(Evaluation Criteria)

A: Fogging of less than 0.5%

B: Fogging of 0.5% or more and less than 1.0%

C: Fogging of 1.0% or more and less than 2.0%

D: Fogging of 2.0% or more and less than 3.0%

E: Fogging of 3.0% or more

<Evaluation of Low-Temperature Fixability>

The low-temperature fixability was evaluated in a normal-temperature and normal-humidity (23° C., 50% RH) environment with a remodeled machine obtained by remodeling a digital copying machine (trade name: image RUNNER 4051) manufactured by Canon Inc. so that the machine had a process speed of 252 mm/second. Paper of 80 g/m$^2$ (OCE RED LABEL, A3) was used as evaluation paper. Nine pieces of half-tone patches each measuring 20 mm×20 mm were uniformly printed on the A3 paper, and a developing bias was set so that the image density was 0.6. Next, the controlled temperature of a fixing device was changed to a predetermined controlled temperature, and cooling was performed until the temperature of a pressure roller in the fixing device became 30° C. or less. Then, 20 sheets of paper were continuously one-side printed (image formation). As samples for the evaluation of the low-temperature fixability, the first, third, fifth, tenth, and twentieth images were sampled. A load of 4.9 kPa was applied onto the obtained fixed images, and the fixed images were rubbed with silbon paper (lens-cleaning paper) in 5 reciprocations. Among the 5 samples, the worst value of an image density reduction ratio before and after the rubbing on average of the 9 pieces was defined as an image density reduction ratio at respective temperatures. The fixation controlled temperature was changed from 170° C. to 210° C. by 5° C., and a fixation controlled temperature at which the image density reduction ratio became 20% or less was defined as a fixation starting temperature. The low-temperature fixability was evaluated based on the fixation starting temperature.

It should be noted that the image density was measured with a Macbeth densitometer manufactured by Macbeth (trade name: RD-914) using an SPI auxiliary filter.

(Evaluation Criteria)

A: The fixation starting temperature is less than 180° C.

B: The fixation starting temperature is 180° C. or more and less than 190° C.

C: The fixation starting temperature is 190° C. or more and less than 200° C.

D: The fixation starting temperature is 200° C. or more and less than 210° C.

E: The fixation starting temperature is 210° C. or more.

Examples 2 to 14

Toners Nos. 2 to 14 were produced in the same manner as in Example 1 except that the formulations in Example 1 were changed as shown in Table 4. In addition, the toners Nos. 2 to 14 were evaluated by the same methods as in Example 1. The evaluation results are shown in Table 5.

Comparative Examples 1 to 5

Toners Nos. 15 to 19 were produced in the same manner as in Example 1 except that the formulations in Example 1 were changed as shown in Table 4. In addition, the toners Nos. 15 to 19 were evaluated by the same methods as in Example 1. The evaluation results are shown in Table 5.

The toner of Comparative Example 1 had evaluation values E for the coarseness, scattering, tailing, density, fogging, and low-temperature fixability. The carbon number of the aliphatic monocarboxylic acid in the binder resin L8 was as considerably small as 28. Therefore, it is considered that the binder resin had no effect on uniform dispersion of the magnetic iron oxide particles. In consequence, it is considered that there was no effect on the coarseness, scattering, tailing, density, fogging, and low-temperature fixability.

The toner of Comparative Example 2 had evaluation values E for the coarseness, scattering, tailing, density, fogging, and low-temperature fixability. The magnetic iron oxide particles 12 had a ratio D10/D50 of 0.39 and a ratio D90/D50 of 1.51. Therefore, it is considered that the electrical resistance varied in the toner between a portion in which larger magnetic iron oxide particles were present and a portion in which smaller magnetic iron oxide particles were present, owing to the magnetic iron oxide particles 12 having a broad particle size distribution. In consequence, it is considered that there was no effect on the coarseness, scattering, tailing, density, fogging, and low-temperature fixability.

The toner of Comparative Example 3 had evaluation values E for the coarseness, scattering, tailing, density, fogging, and low-temperature fixability. The carbon number of the aliphatic monocarboxylic acid in the binder resin L9 was as considerably large as 104, and in addition, the magnetic iron oxide particles 13 had as considerably small a D50 as 0.04, and had a ratio D10/D50 of 0.30 and a ratio D90/D50 of 1.55. Therefore, it is considered that the electrical resistance varied in the toner between a portion in which larger magnetic iron oxide particles were present and a portion in which smaller magnetic iron oxide particles were present, owing to the magnetic iron oxide particles 13 having a broad particle size distribution. In consequence, it is considered that there was no effect on the coarseness, scattering, tailing, density, fogging, and low-temperature fixability.

The toner of Comparative Example 4 had evaluation values E for the coarseness, scattering, tailing, density, fogging, and low-temperature fixability. The binder resins H7 and L10 each did not have an aliphatic compound condensed therein. Besides, the magnetic iron oxide particles 14 had as considerably large a D50 as 0.16, and had a ratio D10/D50 of 0.35 and a ratio D90/D50 of 1.58. Therefore, it is considered that the electrical resistance varied in the toner between a portion in which larger magnetic iron oxide particles were present and a portion in which smaller magnetic iron oxide particles were present, owing to the magnetic iron oxide particles 14 having a broad particle size distribution. In consequence, it is considered that there was no effect on the coarseness, scattering, tailing, density, fogging, and low-temperature fixability.

The toner of Comparative Example 5 had evaluation values E for the coarseness, scattering, tailing, density, fogging, and low-temperature fixability. The binder resins H7 and L10 each did not have an aliphatic compound condensed therein. Besides, the content of the magnetic iron oxide particles 15 was as considerably large as 90 parts, and the magnetic iron oxide particles 15 had as considerably large a D50 as 0.17, and had a ratio D10/D50 of 0.30 and a ratio D90/D50 of 1.60. Therefore, it is considered that the electrical resistance varied in the toner between a portion in which larger magnetic iron oxide particles were present and a portion in which smaller magnetic iron oxide particles were present, owing to the magnetic iron oxide particles 15 having a broad particle size distribution. In consequence, it is considered that there was no effect on the coarseness, scattering, tailing, density, fogging, and low-temperature fixability.

TABLE 4

| | Binder resin | | | | | |
|---|---|---|---|---|---|---|
| | Binder resins H1 to H7 | Amount (parts by mass) | Binder resins L1 to L10 | Amount (parts by mass) | Magnetic iron oxide particles | Amount (parts by mass) |
| Toner 1 | H1 | 70 | L1 | 30 | 1 | 60 |
| Toner 2 | H2 | 70 | L1 | 30 | 2 | 60 |
| Toner 3 | H2 | 70 | L1 | 30 | 3 | 60 |
| Toner 4 | H2 | 70 | L2 | 30 | 4 | 60 |
| Toner 5 | H3 | 70 | L3 | 30 | 4 | 60 |
| Toner 6 | H4 | 70 | L3 | 30 | 4 | 60 |
| Toner 7 | H4 | 70 | L3 | 30 | 5 | 60 |
| Toner 8 | H5 | 70 | L4 | 30 | 6 | 75 |
| Toner 9 | H6 | 70 | L4 | 30 | 7 | 75 |
| Toner 10 | H6 | 70 | L4 | 30 | 8 | 75 |
| Toner 11 | H6 | 70 | L4 | 30 | 9 | 75 |
| Toner 12 | H7 | 70 | L5 | 30 | 9 | 40 |
| Toner 13 | H7 | 70 | L6 | 30 | 10 | 30 |
| Toner 14 | H7 | 70 | L7 | 30 | 11 | 80 |
| Toner 15 | H7 | 70 | L8 | 30 | 11 | 80 |
| Toner 16 | H7 | 70 | L7 | 30 | 12 | 80 |
| Toner 17 | H7 | 70 | L9 | 30 | 13 | 80 |
| Toner 18 | H7 | 70 | L10 | 30 | 14 | 80 |
| Toner 19 | H7 | 70 | L10 | 30 | 15 | 90 |

TABLE 5

| | | Coarseness | Scattering | Tailing | Density | Fogging | Low-temperature fixability |
|---|---|---|---|---|---|---|---|
| Example 1 | Toner 1 | A (1.5) | A | A (0.99) | A (0.02) | A (0.1) | A (175) |
| Example 2 | Toner 2 | A (1.6) | B | A (0.98) | A (0.03) | A (0.1) | A (175) |
| Example 3 | Toner 3 | A (1.7) | B | B (0.93) | A (0.06) | A (0.3) | A (175) |
| Example 4 | Toner 4 | A (1.7) | B | B (0.92) | A (0.07) | B (0.6) | A (175) |
| Example 5 | Toner 5 | A (1.8) | B | B (0.92) | A (0.07) | B (0.6) | B (180) |
| Example 6 | Toner 6 | B (2.8) | B | B (0.91) | B (0.14) | B (0.7) | B (180) |
| Example 7 | Toner 7 | B (3.4) | C | C (0.86) | B (0.15) | B (0.8) | B (180) |
| Example 8 | Toner 8 | B (3.4) | C | C (0.86) | B (0.15) | B (0.8) | C (190) |
| Example 9 | Toner 9 | B (3.4) | C | C (0.84) | B (0.15) | C (1.6) | C (190) |
| Example 10 | Toner 10 | C (5.0) | C | C (0.83) | C (0.24) | C (1.7) | C (190) |
| Example 11 | Toner 11 | D (6.4) | C | C (0.82) | D (0.34) | C (1.8) | C (190) |

TABLE 5-continued

| | | Coarseness | Scattering | Tailing | Density | Fogging | Low-temperature fixability |
|---|---|---|---|---|---|---|---|
| Example 12 | Toner 12 | D (6.4) | C | D (0.74) | D (0.34) | C (1.9) | C (190) |
| Example 13 | Toner 13 | D (7.0) | D | D (0.71) | D (0.38) | D (2.6) | C (195) |
| Example 14 | Toner 14 | D (7.0) | D | D (0.71) | D (0.38) | D (2.6) | D (205) |
| Comparative Example 1 | Toner 15 | E (8.7) | E | E (0.65) | E (0.44) | E (3.4) | E (210) |
| Comparative Example 2 | Toner 16 | E (8.7) | E | E (0.65) | E (0.44) | E (3.5) | E (210) |
| Comparative Example 3 | Toner 17 | E (9.3) | E | E (0.60) | E (0.48) | E (3.8) | E (215) |
| Comparative Example 4 | Toner 18 | E (9.6) | E | E (0.59) | E (0.48) | E (3.9) | E (220) |
| Comparative Example 5 | Toner 19 | E (9.7) | E | E (0.57) | E (0.48) | E (3.9) | E (220) |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application Nos. 2014-090456, filed Apr. 24, 2014 and 2015-083617, filed on Apr. 15, 2015, which are hereby incorporated by reference herein in their entirety.

What is claimed is:

1. A magnetic toner, comprising a toner particle containing a binder resin and a magnetic iron oxide particle, wherein:

the binder resin comprises a resin having a polyester unit in which at least one kind of aliphatic compound selected from the group consisting of an aliphatic monocarboxylic acid having 30 or more and 102 or less carbon atoms and an aliphatic monoalcohol having 30 or more and 102 or less carbon atoms is condensed at an end of the polyester unit;

a content of the magnetic iron oxide particle in the toner particle is 30 parts by mass or more and 80 parts by mass or less with respect to 100 parts by mass of the binder resin in the toner particle; and the magnetic iron oxide particle satisfies the following conditions (i) to (iii):

(i) a number-based median diameter D50 is 0.05 μm or more and 0.15 μm or less;

(ii) a ratio D10/D50 is 0.40 or more and 1.00 or less, when a particle diameter at which a cumulative ratio in a number-based particle size distribution from a smaller particle diameter side reaches 10% is defined as D10; and (iii) a ratio D90/D50 is 1.00 or more and 1.50 or less, when a particle diameter at which a cumulative ratio in the number-based particle size distribution from the smaller particle diameter side reaches 90% is defined as D90.

2. A magnetic toner according to claim 1, wherein the resin having a polyester unit comprises a resin produced by using 0.10 part by mass or more and 10 parts by mass or less of the aliphatic compound with respect to 100 parts by mass of a total mass of monomers for forming the polyester unit.

3. A magnetic toner according to claim 1, wherein:

the magnetic iron oxide particle contains silicon atoms; and a content of the silicon atoms in the magnetic iron oxide particle is 0.19 atomic % or more and 1.90 atomic % or less with respect to iron atoms in the magnetic iron oxide particle.

4. A magnetic toner according to claim 3, wherein the magnetic iron oxide particle has a ratio (B/A)×100 of 50(%) or less, when an amount of eluted silicon atoms is represented by A when the silicon atoms present in surface of the magnetic iron oxide particle are eluted with hydrochloric acid, and an amount of eluted silicon atoms is represented by B when the silicon atoms present in surface of the magnetic iron oxide particle are eluted with a sodium hydroxide aqueous solution.

5. A magnetic toner according to claim 1, wherein the content of the magnetic iron oxide particle in the toner particle is 40 parts by mass or more and 75 parts by mass or less with respect to 100 parts by mass of the binder resin in the toner particle.

6. A magnetic toner according to claim 1, wherein the magnetic iron oxide particle has the D50 of 0.10 μm or more and 0.14 μm or less.

7. A magnetic toner according to claim 1, wherein the magnetic iron oxide particle has the ratio D10/D50 of 0.55 or more and 1.00 or less.

8. A magnetic toner according to claim 1, wherein the magnetic iron oxide particle has the ratio D90/D50 of 1.00 or more and 1.45 or less.

9. A magnetic toner according to claim 1, wherein the magnetic iron oxide particle has the ratio (B/A)×100 of 42(%) or less.

* * * * *